US007358023B2

(12) United States Patent
Yamazaki et al.

(10) Patent No.: US 7,358,023 B2
(45) Date of Patent: Apr. 15, 2008

(54) METHOD FOR PRODUCING TONER, TONER AND PRINTED MATTER

(75) Inventors: Soichi Yamazaki, Nagano (JP); Hiroyuki Murakami, Nagano (JP); Masahide Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/390,580

(22) Filed: Mar. 14, 2003

(65) Prior Publication Data

US 2004/0029031 A1 Feb. 12, 2004

(30) Foreign Application Priority Data

Mar. 15, 2002 (JP) ..... P.2002-072973
Mar. 15, 2002 (JP) ..... P.2002-072974

(51) Int. Cl.
*G03G 9/087* (2006.01)

(52) U.S. Cl. ..... 430/137.18; 430/108.4; 430/109.4; 430/110.3

(58) Field of Classification Search ..... 430/108.4, 430/137.1, 109.4, 110.3, 137.18
See application file for complete search history.

(56) References Cited

U.S. PATENT DOCUMENTS 4,863,824 A 9/1989 Uchida et al.
5,057,392 A 10/1991 McCabe et al.
5,147,747 A 9/1992 Wilson et al.
5,232,806 A * 8/1993 Yamada et al. ..... 430/108.6
5,840,456 A * 11/1998 Tomita et al. ..... 430/109.1
6,022,661 A * 2/2000 Kurose et al. ..... 430/108.7
6,063,535 A * 5/2000 Tsutsui et al. ..... 430/101
6,063,537 A * 5/2000 Nakamura et al. ..... 430/110.3
6,383,705 B2 5/2002 Aoki et al.
6,492,084 B2 12/2002 Tomita
6,503,679 B2 * 1/2003 Aoki et al. ..... 430/108.8
6,509,130 B1 1/2003 Semura et al.
6,653,039 B2 11/2003 Tomita
6,686,112 B2 2/2004 Teshima et al.

FOREIGN PATENT DOCUMENTS

CN 1321917 A 11/2001

(Continued)

OTHER PUBLICATIONS

Diamond, A.S., ed., *Handbook of Imaging Materials*, Marcel Dekker, Inc., NY (1991), p. 161.*

(Continued)

*Primary Examiner*—Janis L. Dote
(74) *Attorney, Agent, or Firm*—Sughure Mion, PLLC

(57) ABSTRACT

The invention provides a method for producing a toner comprising: a step of preparing a powder for production of the toner from a raw material containing a resin as a main component, a coloring agent, and a crystalline polyester having higher crystallinity than the resin as an accessory component, and a thermal conglobation step of conglobating the powder for production of the toner with heat. The invention also provides a method for producing a toner from a kneaded material obtained by kneading a raw material containing a resin and a coloring agent, wherein the resin comprises at least a first polyester resin and a second polyester resin different from the first polyester resin, and wherein when the coefficient of static friction of the first polyester resin is taken as $\mu_1$, the coefficient of static friction of the second polyester resin as $\mu_2$, the softening point of the first polyester resin as $T_{s1}$ (° C.) and the softening point of the second polyester resin as $T_{s2}$ (° C.), the relationship $\mu_1>\mu_2$ and the relationship $T_{s1}>T_{s2}$ are satisfied.

23 Claims, 2 Drawing Sheets

FOREIGN PATENT DOCUMENTS

| | | | |
|---|---|---|---|
| EP | 0 495 475 | A | 7/1992 |
| EP | 0 822 456 | A1 | 2/1998 |
| EP | 1 126 324 | A1 | 8/2001 |
| JP | 9-034175 | A | 2/1997 |
| JP | 09-106105 | A | 4/1997 |
| JP | 10-254173 | A | 9/1998 |
| JP | 11-024313 | A | 1/1999 |
| JP | 11-295929 | A | 10/1999 |
| JP | 2000-003069 | A | 1/2000 |
| JP | 2000-172009 | A | 6/2000 |
| JP | 2001-022124 | A | 1/2001 |
| JP | 2001-100456 | A | 4/2001 |
| JP | 2001-222138 | A | 8/2001 |
| JP | 2001-265049 | A | 9/2001 |
| JP | 2001-265056 | A | 9/2001 |

OTHER PUBLICATIONS

Grant, R., et al., ed., *Grant & Hackh's Chemical Dictionary*, fifth edition, McGraw-Hill Book Company, NY (1987), pp. 275, 276, 330, and 359.*

Warth, A. H., *The Chemistry and Technology of Waxes*, Reinhold Publishing Corp., NY (1956), pp. 162-165.*

Office Action—The Peoples Republic of China, App. No. 03119329.3, dated Sep. 30, 2005.

Office Action of Mar. 17, 2006 in Chinese Patent Application No. 03119329.3.

* cited by examiner

METHOD FOR PRODUCING TONER, TONER AND PRINTED MATTER

FIELD OF THE INVENTION

The present invention relates to a method for producing a toner, a toner produced thereby and printed matter.

BACKGROUND OF THE INVENTION

Many methods have been known as electrophotography. In general, such methods each comprises the process of forming an electrostatic latent image on a photosensitive member by various means using a photoconductive material (exposure process), the development process of developing the latent image by the use of a toner, the transfer process of transferring a toner image to a transfer material such as paper, and the fixing process of fixing the toner image by heating and pressurization using a fixing roll.

In order to effectively transfer the toner image in the transfer process, it has been conducted that a wax excellent in releasability is added to the toner.

The wax-containing toner is usually produced as described below.

First, a raw material containing a resin that is a main component (hereinafter also briefly referred to as a "resin"), a coloring agent and the wax is kneaded at a temperature equal to or higher than the softening point of the resin to obtain a kneaded material. The kneaded material thus obtained is cooled to a temperature equal to or lower than the melting point of the resin, and then pulverized. An additive (external additive) is further added as needed to produce the intended toner.

Now, in general, wax is known to be low in compatibility with a resin, a main component of a toner. Accordingly, in order to sufficiently finely dispersing the wax, kneading treatment for thoroughly kneading the above-mentioned raw material has been conducted.

However, in a case where the content of the wax is relatively increased in order to obtain sufficient releasability, wax particles cannot be sufficiently finely dispersed in toner particles finally obtained, in some cases, even when the kneading treatment is sufficiently conducted. When the wax particles cannot be sufficiently finely dispersed like this (when the wax particles are coarsened), the wax oozes out remarkably. The wax that has oozed out adheres to the photosensitive member in large amounts (filming) in some cases. When the wax adheres to the photosensitive member like this, it has sometimes happened that the transfer efficiency of the toner to the transfer material rather decreases. The toner in which the wax particles are coarsened decreases in its mechanical strength to cause poor durability. Further, the toner in which the wax particles are coarsened also has the problem that a so-called fogging phenomenon is liable to occur.

On the other hand, when the content of the wax is decreased in order to prevent the wax particles from being coarsened as described above, sufficient releasability is not obtained, resulting in a decrease in the transfer efficiency to the transfer material.

SUMMARY OF THE INVENTION

An object of the invention is to provide a toner excellent in transfer efficiency and durability.

Another object of the invention is to provide a toner production method that can produce the toner.

A still other object of the invention is to provide clear printed matter decreased in fogging and offset.

Other objects and effects of the invention will become apparent from the following description.

In the first aspect of the present invention, the above-described objects have been achieved by providing the production methods and toners as set forth in the following items (1) to (35).

(1) A method for producing a toner comprising:

a step of preparing a powder for production of the toner from a raw material containing a resin as a main component, a coloring agent, and a crystalline polyester having higher crystallinity than the resin as an accessory component, and a thermal conglobation step of conglobating the powder for production of the toner with heat.

(2) The method according to item (1), wherein the thermal conglobation step is carried out at an atmospheric temperature of from 150° C. to 500° C.

(3) The method according to item (1) or (2), wherein the thermal conglobation step allow the toner to have an average degree of circularity R, which is represented by the following equation (I), of 0.92 or more:

$$R=L_0/L_1 \quad \text{(I)}$$

wherein $L_1$ (μm) represents the circumferential length of a projected image of a toner particle to be measured, and $L_0$ (μm) represents the circumferential length of a complete circle having an area equivalent to that of the projected image of the toner particle to be measured.

(4) The method according to any one of items (1) to (3), wherein the crystalline polyester satisfies the relationship $T_{mp}-T_{ms} \leqq 30$ (° C.), wherein when an endothermic peak of the melting point is measured by differential scanning calorimetric analysis, the center value of the peak is taken as $T_{mp}$ (° C.) and the shoulder peak value as $T_{ms}$ (° C.).

(5) The method according to any one of items (1) to (4), wherein the crystalline polyester has a heat of fusion of 1 mJ/mg or more, which is determined when an endothermic peak of the melting point is measured by differential scanning calorimetric analysis.

(6) The method according to any one of items (1) to (5), wherein the crystalline polyester contains an aliphatic carboxylic acid as an acid component.

(7) The method according to any one of items (1) to (6), wherein the crystalline polyester contains an aliphatic alcohol as an alcohol component.

(8) The method according to any one of items (1) to (7), wherein the crystalline polyester is a linear polymer.

(9) The method according to any one of items (1) to (8), wherein the content of the crystalline polyester in the raw material is from 1 to 30 parts by weight per 100 parts by weight of the resin.

(10) The method according to any one of items (1) to (9), wherein the crystalline polyester has a melting point of 0° C. to 300° C.

(11) The method according to any one of items (1) to (10), wherein the resin is excellent in compatibility with the crystalline polyester.

(12) The method according to any one of items (1) to (11), wherein the resin comprises a polyester in an amount of 50% by weight or more.

(13) The method according to any one of items (1) to (12), wherein the raw material contains a wax.

(14) The method according to item (13), wherein the wax is an ester-based wax.

(15) The method according to item (13), wherein the wax is an olefinic wax.

(16) The method according to any one of items (13) to (15), wherein the content of the wax in the raw material is 20% by weight or less.

(17) The method according to any one of items (1) to (16), wherein the toner has an average particle size of 2 to 20 μm.

(18) A toner comprising a resin as a main component, a crystalline polyester having higher crystallinity than the resin, and a coloring agent, wherein the toner has an average degree of circularity R represented by the following equation (I) is 0.92 or more:

$$R=L_0/L_1 \quad (I)$$

wherein $L_1$ (μm) represents the circumferential length of a projected image of a toner particle to be measured, and $L_0$ (μm) represents the circumferential length of a complete circle having an area equivalent to that of the projected image of the toner particle to be measured.

(19) A toner comprising a resin as a main component, a crystalline polyester having higher crystallinity than the resin, and a coloring agent, which has been conglobated by thermal conglobation treatment.

(20) The toner according to item (19), wherein the toner has an average degree of circularity R represented by the following equation (I) is 0.92 or more:

$$R=L_0/L_1 \quad (I)$$

wherein $L_1$ (μm) represents the circumferential length of a projected image of a toner particle to be measured, and $L_0$ (μm) represents the circumferential length of a complete circle having an area equivalent to that of the projected image of the toner particle to be measured.

(21) The toner according to any one of items (18) to (20), wherein the crystalline polyester satisfies the relationship $T_{mp}-T_{ms}\leqq 30$ (° C.), wherein $T_{mp}$ (° C.) and $T_{ms}$ (° C.) are the center value of the peak and the shoulder peak value, respectively, wherein when an endothermic peak of the melting point is measured by differential scanning calorimetric analysis, the center value of the peak is taken as $T_{mp}$ (° C.) and the shoulder peak value as $T_{ms}$ (° C.).

(22) The toner according to any one of items (18) to (21), wherein the crystalline polyester has a heat of fusion of 1 mJ/mg or more, which is determined when an endothermic peak of the melting point is measured by differential scanning calorimetric analysis.

(23) The toner according to any one of items (18) to (22), wherein the crystalline polyester contains an aliphatic carboxylic acid as an acid component.

(24) The toner according to any one of items (18) to (23), wherein the crystalline polyester contains an aliphatic alcohol as an alcohol component.

(25) The toner according to any one of items (18) to (24), wherein the crystalline polyester is a linear polymer.

(26) The toner according to any one of items (18) to (25), wherein the content of the crystalline polyester is from 1 to 30 parts by weight.

(27) The toner according to any one of items (18) to (26), wherein the crystalline polyester has a melting point of 0° C. to 300° C.

(28) The toner according to any one of items (18) to (27), wherein the resin is excellent in compatibility with the crystalline polyester.

(29) The toner according to any one of items (18) to (28), wherein the resin comprises a polyester in an amount of 50% by weight or more.

(30) The toner according to any one of items (18) to (29), which contains a wax.

(31) The toner according to item (30), wherein the wax is an ester-based wax.

(32) The toner according to item (30), wherein the wax is an olefinic wax.

(33) The toner according to any one of items (18) to (32), wherein the content of the wax is 20% by weight or less.

(34) The toner according to any one of items (18) to (33), which has an average particle size of 2 to 20 μm.

(35) A toner produced by the method according to any one of items (1) to (17).

In the second aspect of the invention, the above-described objects have been achieved by providing the production methods, toners and printed matter as set forth in the following items (36) to (70).

(36) A method for producing a toner from a kneaded material obtained by kneading a raw material containing a resin and a coloring agents wherein the resin comprises at least a first polyester resin and a second polyester resin different from the first polyester resin, and wherein when the coefficient of static friction of the first polyester resin is taken as $\mu_1$, the coefficient of static friction of the second polyester resin as $\mu_2$, the softening point of the first polyester resin as $T_{s1}$ (° C.) and the softening point of the second polyester resin as. $T_{s2}$ (° C.), the relationship $\mu_1>\mu_2$ and the relationship $T_{s1}>T_{s2}$ are satisfied.

(37) The method according to item (36), which comprises a thermal conglobation step of conglobating a powder for production of the toner, which is obtained by pulverizing the kneaded material, with heat.

(38) The method according to item (36) or (37), wherein the atmospheric temperature in the thermal conglobation step is from 150° C. to 500° C.

(39) The method according to item (37) or (38), wherein the thermal conglobation step allows the toner to have an average degree of circularity R, which is represented by the following equation (I), of 0.92 or more:

$$R=L_0/L_1 \quad (I)$$

wherein $L_1$ (μm) represents the circumferential length of a projected image of a toner particle to be measured, and $L_0$ (μm) represents the circumferential length of a complete circle having an area equivalent to that of the projected image of the toner particle to be measured.

(40) The method according to any one of items (36) to (39), wherein the kneading is conducted, while adjusting the temperature of the raw material to 50° C. to 300° C.

(41) The method according to any one of items (36) to (40), wherein when the content of the first polyester resin is taken as $C_1$ (% by weight) and the content of the second polyester resin as $C_2$ (% by weight), the relationship $C_1>C_2$ is satisfied.

(42) The method according to any one of items (36) to (41), wherein the content of the first polyester resin in the raw material is from 50% to 99% by weight.

(43) The method according to any one of items (36) to (42), wherein the softening point of the first polyester resin is from 50° C. to 300° C.

(44) The method according to any one of items (36) to (43), wherein the content of the second polyester resin in the raw material is from 1% to 50% by weight.

(45) The method according to any one of items (36) to (44), wherein the softening point of the second polyester resin is from 40° C. to 200° C.

(46) The method according to any one of items (36) to (45), wherein the second polyester resin contains an aliphatic carboxylic acid as an acid component.

(47) The method according to any one of items (36) to (46), wherein the second polyester resin contains an aliphatic alcohol as an alcohol component.

(48) The method according to any one of items (36) to (47), wherein the second polyester resin is a linear polymer.

(49) The method according to any one of items (36) to (48), wherein the second polyester resin satisfies the relationship $T_{mp}-T_{ms} \leqq 30$ (° C.), wherein when an endothermic peak of the melting point is measured by differential scanning calorimetric analysis, the center value of the peak is taken as $T_{mp}$ (° C.) and the shoulder peak value as $T_{ms}$ (° C.).

(50) The method according to any one of items (36) to (49), wherein the content of the resin in the raw material is from 51% to 99% by weight.

(51) The method according to any one of items (36) to (50), wherein the toner has an average particle size of 2 to 20 μm.

(52) The method according to any one of items (36) to (51), wherein the content of a wax in the raw material is 20% by weight or less.

(53) A toner comprising a raw material containing a resin and a coloring agent, wherein the resin comprises at least a first polyester resin and a second polyester resin different from the first polyester resin, and wherein when the coefficient of static friction of the first polyester resin is taken as $\mu_1$, the coefficient of static friction of the second polyester resin as $\mu_2$, the softening point of the first polyester resin as $T_{s1}$ (° C.) and the softening point of the second polyester resin as $T_{s2}$ (° C.), the relationship $\mu_1>\mu_2$ and the relationship $T_{s1}>T_{s2}$ are satisfied.

(54) The toner according to item (53), wherein when the content of the first polyester resin is taken as $C_1$ (% by weight) and the content of the second polyester resin as $C_2$ (% by weight), the relationship $C_1>C_2$ is satisfied.

(55) The toner according to items (53) or (54), wherein the content of the first polyester resin in the raw material is from 50% to 99% by weight.

(56) The toner according to any one of items (53) to (55), wherein the softening point of the first polyester resin is from 50° C. to 300° C.

(57) The toner according to any one of items (53) to (56), wherein the content of the second polyester resin in the raw material is from 1% to 50% by weight.

(58) The toner according to any one of items (53) to (57), wherein the softening point of the second polyester resin is from 40° C. to 200° C.

(59) The toner according to any one of items (53) to (58), wherein the second polyester resin contains an aliphatic carboxylic acid as an acid component.

(60) The toner according to any one of items (53) to (59), wherein the second polyester resin contains an aliphatic alcohol as an alcohol component.

(61) The toner according to any one of items (53) to (60), wherein the second polyester resin is a linear polymer.

(62) The toner according to any one of items (53) to (61), wherein the second polyester resin satisfies the relationship $T_{mp}-T_{ms} \leqq 30$ (° C.), wherein when an endothermic peak of the melting point is measured by differential scanning calorimetric analysis, the center value of the peak is taken as $T_{mp}$ (° C.) and the shoulder peak value as $T_{ms}$ (° C.).

(63) The toner according to any one of items (53) to (62), which is conglobated by thermal conglobation treatment.

(64) The toner according to any one of items (53) to (63), wherein the average degree of circularity R represented by the following equation (I) is 0.92 or more:

$$R=L_0/L_1 \quad \text{(I)}$$

wherein $L_1$ (μm) represents the circumferential length of a projected image of a toner particle to be measured, and $L_0$ (μm) represents the circumferential length of a complete circle having an area equivalent to that of the projected image of the toner particle to be measured.

(65) The toner according to any one of items (53) to (64), wherein the content of the resin is from 51% to 99% by weight.

(66) The toner according to any one of items (53) to (65), which has an average particle size of 2 to 20 μm.

(67) The toner according to any one of items (53) to (65), wherein the content of a wax is 20% by weight or less.

(68) A toner produced by the method according to any one of items (36) to (52).

(69) Printed matter printed using the toner produced by the method according to any one of items (36) to (52).

(70) Printed matter printed using the toner according to any one of items (53) to (68).

BRIEF DESCRIPTION OF THE DRAWINGS

Referring to FIG. 1, description is hereinafter made, taking the left side as a "base end" and the right end as a "leading end".

DETAILED DESCRIPTION OF THE INVENTION

<First Aspect of the Invention>

Figure 1:
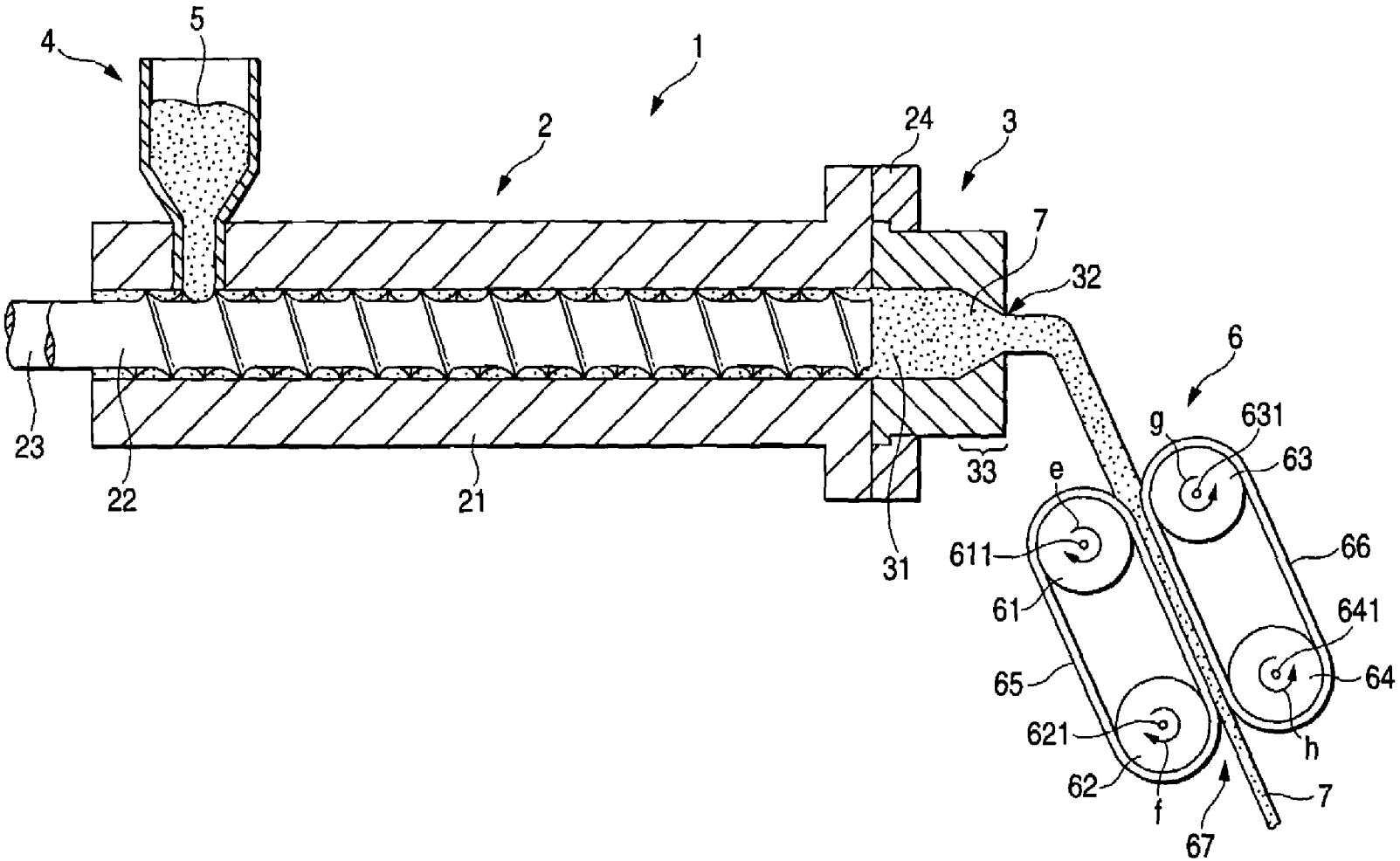
FIG. 1 is a schematic longitudinal sectional view showing an example of the construction of a kneader and a cooling device.

Preferred embodiments of the toner production method and the toner according to the first aspect of the invention will be described below in detail with reference to the accompanying drawings.

Constituent Materials

The toner according to the first aspect of the invention is produced using a raw material 5 containing at least a resin (hereinafter also briefly referred to as a "resin") as a main component, a crystalline polyester as an accessory component, and a coloring agent.

The respective components of the raw material 5 used for production of the toner according to the first aspect of the invention are described below.

A1: Resin (Binder Resin)

As the resin (binder resin), there may be used any resin, as long as it has lower crystallinity than a crystalline polyester described later. Examples of the resins include a styrenic resin, or a homopolymer or a copolymer containing styrene or a styrene-substituent component, such as polystyrene, poly-α-methylstyrene, polychlorostyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer, a styrene-methacrylate copolymer, a styrene-acrylate-methacrylate copolymer, a styrene-methyl α-chloroacrylate copolymer, a styrene-acrylonitrile-acrylate copolymer or a styrene-vinyl methyl ether copolymer, a polyester resin (having lower crystallinity than the crystalline polyesters described later), an epoxy resin, a urethane-modified epoxy resin, a silicone-modified epoxy resin, a vinyl chloride resin, a rosin-modified epoxy resin, a phenyl resin, polyethylene, polypropylene, an ionomer resin, a polyurethane resin, a silicone resin, a ketone resin, an ethylene-ethyl acrylate copolymer, a xylene resin, a polyvinyl butyral resin, a terpene resin, a phenol resin and an aliphatic or alicyclic hydrocarbon resin. They can be used either alone or as a combination of two or more of them. Of these, one mainly composed of the polyester resin (particularly, one in which the polyester is contained in an amount of 60% by weight or more) is preferred. The use of such a material as the resin results in particularly excellent compatibility with the crystalline polyester described later. As a result, variations in composition (the content of each component) among the respective particles of the toner finally obtained can be decreased to obtain stable characteristics as the whole toner.

Although there is no particular limitation on the content of the resin in the raw material 5, it is preferably from 50% to 99% by weight, and more preferably from 80% to 98% by weight. When the content of the resin is less than the above-mentioned lower limit, the functions of the resin (for example, good fixing ability in a wide temperature region) might not be sufficiently exhibited in the toner finally obtained. On the other hand, when the content of the resin exceeds the above-mentioned upper limit, the content of the crystalline polyester described later relatively decreases to cause failure to sufficiently obtain the effect of adding the crystalline polyester, resulting in a decrease in the transfer efficiency.

Further, the melting point of the resin is preferably from 50° C. to 250° C., and more preferably from 90° C. to 150° C. When the melting point of the resin is less than the above-mentioned lower limit, the keeping quality (heat resistance) of the toner is lowered to cause the occurrence of fusion among the toner particles depending on the use environment in some cases. On the other hand, when the melting point of the resin exceeds the above-mentioned upper limit, high temperatures are required in fixing the toner on the transfer material such as paper, which induces a load on a main body of electrophotographic photoreceptor.

A2: Crystalline Polyester

The crystalline polymer is one having higher crystallinity than the above-mentioned resin. The first aspect of the invention has a feature that such a crystalline polyester is used as an accessory component.

The crystalline polyester high in crystallinity has the so-called sharp melt quality. That is to say, the crystalline polyester has the property that when an endothermic peak of the melting point is measured by differential scanning calorimetric analysis (DSC), the endothermic peak appears as a sharp shape, compared to a material low in crystallinity.

By containing the crystalline polyester having the sharp melt quality in the raw material 5, the toner particles particularly excellent in the average degree of circularity (having a shape near the complete circle) can be obtained in conducting thermal conglobation treatment.

Further, by containing the crystalline polyester having the sharp melt quality in the raw material 5, it becomes possible to surely fuse the toner particles at relatively low temperatures. That is to say, the transfer efficiency of the toner can be improved.

Figure 2:
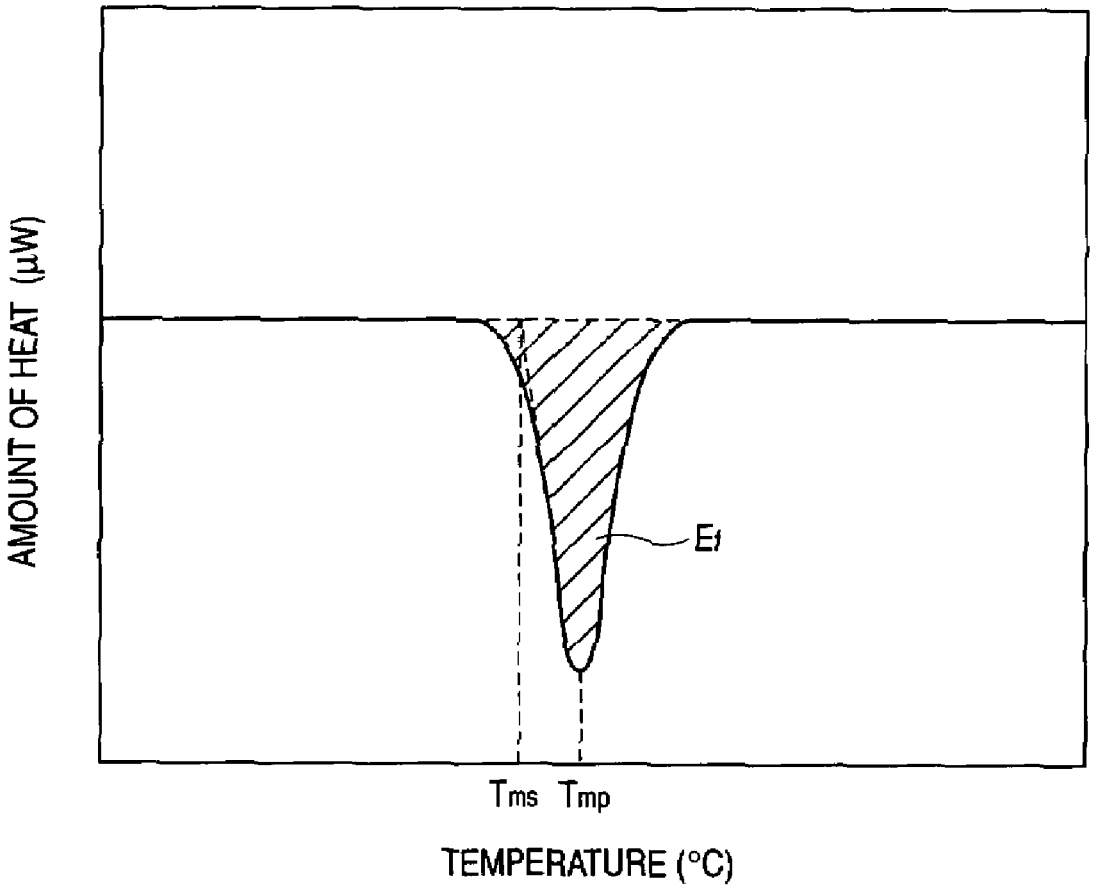
FIG. 2 is a model chart showing a differential scanning calorimetric analysis curve in the vicinity of the melting point of a crystalline polyester (or a second polyester resin), which is obtained by differential scanning calorimetric analysis for the crystalline polyester (or the second polyester resin).

As an index for indicating crystallinity, there is, for example, the ΔT value represented by $\Delta T = T_{mp} - T_{ms}$, wherein when an endothermic peak of the melting point is measured by differential scanning calorimetric analysis (DSC), the center value of the peak is taken as $T_{mp}$ (° C.) and the shoulder peak value as $T_{ms}$ (° C.) (refer to FIG. 2). The lower this ΔT value is, the higher the crystallinity is.

The ΔT value of the crystalline polyester is preferably 30° C. or less, and more preferably 10° C. or less. The measuring conditions of $T_{mp}$ (° C.) and $T_{ms}$ (° C.) are described below. That is, they are measured by elevating the temperature of a crystalline polyester sample to 300° C. at a rate of temperature rise of 10° C./minute, further lowering it at a rate of temperature decrease of 10° C./minute, and then elevating it at a rate of temperature rise of 10° C./minute.

As described above, the crystalline polyester has higher crystallinity than the resin (binder resin) that is the main component. Accordingly, when the ΔT value of the resin is taken as $\Delta T_B$ (° C.) and the ΔT value of the crystalline polyester as $\Delta T_C$ (° C.), the relationship $\Delta T_B > \Delta T_C$ is satisfied. In particular, in the first aspect of the invention, it is preferred that the relationship $\Delta T_B - \Delta T_c > 5$ is satisfied, and it is more preferred that the relationship $\Delta T_B - \Delta T_c > 10$ is satisfied. The above-mentioned effect becomes more significant by satisfying such relationship, with the proviso that when the crystallinity of the resin of the main component is low, and it is difficult to measure (judge) at least one of $T_{mp}$ and $T_{ms}$, $\Delta T_B$ is taken as ∞ (° C.).

Further, the use of the crystalline polyester also gives the following effects. The crystalline polyester has low friction coefficient. Accordingly, even when wax conventionally used is not contained in the toner, excellent releasability is obtained to improve the transfer efficiency of the toner.

Furthermore, the crystalline polyester is excellent in compatibility with the resin described above, so that variations in composition (the content of each component) among the respective particles of the toner finally obtained can be decreased to obtain stable characteristics as the whole toner.

In addition, the crystalline polyester is also excellent in compatibility with a wax (particularly, an ester-based wax) descried later. Accordingly, even when the wax is contained in the raw material, the occurrence of free wax in the toner particles finally obtained and coarsening can be effectively prevented (the fine dispersion and micro phase separation of the wax in the toner can be easily achieved). Further, oozing of the wax to a toner surface, which has hitherto become a problem, can also be effectively prevented.

Further, the crystalline polyester has high strength. According to the first aspect of the invention, therefore, the strength is improved as the whole toner, and the toner comes to have particularly excellent durability.

The crystalline polyester may be any, as long as it has higher crystallinity than the above-mentioned resin. However, one satisfying the following conditions is preferred.

It is preferred that the crystalline polyester has a heat of fusion $E_f$ of 1 mJ/mg or more, which is determined when an endothermic peak of the melting point is measured by differential scanning calorimetric analysis. It is more preferred that the crystalline polyester has a heat of fusion of 5 mJ/mg or more. When the heat of fusion $E_f$ is less than 1 mJ/mg, the above-mentioned effect might not be sufficiently exhibited. In this case, the heat of fusion is understood not to include the amount of heat of an endothermic peak of a grass transition point (refer to FIG. 2). There is no particular limitation on the measuring conditions of the endothermic peak of the melting point. For example, a value measured when the temperature of a crystalline polyester sample is elevated to 300° C. at a rate of temperature rise of 10° C./minute, further lowered at a rate of temperature decrease of 10° C./minute, and then elevated at a rate of temperature rise of 10° C./minute can be determined as the heat of fusion.

The crystalline polyesters include, for example, polyethylene terephthalate (PET), polybutylene terephthalate (PBT), polycyclohexane terephthalate (PCT), polypropylene terephthalate, polyethylene naphthalate and a polyarylate.

The crystalline polyester is preferably a linear type polymer. The linear type polyester has low friction coefficient, compared to a crosslinking type polyester. This provides particularly excellent releasability to further improve the transfer efficiency of the toner.

Further, the crystalline polyester is preferably one containing an aliphatic carboxylic acid as an acid component, more preferably, one in which almost all (for example, 80% by weight or more based on the whole acid component) of the acid component is an aliphatic carboxylic acid, and still more preferably, one in which the acid component is substantially all composed of an aliphatic carboxylic acid. The crystallinity of the crystalline polyester is improved thereby, and the effects as described above (particularly, the effect of decreasing the friction coefficient) become more significant.

Furthermore, the crystalline polyester is preferably one containing an aliphatic alcohol as an alcohol component, more preferably, one in which almost all (for example, 80% by weight or more based on the whole alcohol component) of the alcohol component is an aliphatic alcohol, and still more preferably, one in which the alcohol component is substantially all composed of an aliphatic alcohol. The crystallinity of the crystalline polyester is improved thereby, and the effects as described above (particularly, the effect of decreasing the friction coefficient) become more significant.

As described above, the first aspect of the invention has a feature that the crystalline polyester is used as the accessory component. The content of the crystalline polyester in the raw material 5 is preferably from 1 to 30 parts by weight, and more preferably from 2 to 15 parts by weight, per 100 parts by weight of the resin (binder resin) as the main component. When the content of the crystalline polyester is less than the above-mentioned lower limit, the effect of the invention might not be sufficiently obtained. On the other hand, when the content of the crystalline polyester exceeds the above-mentioned upper limit, the content of the resin as the main component relatively decreases, and the functions of the resin (for example, good fixing ability in a wide temperature region) might not be sufficiently exhibited.

Further, the melting point of the crystalline polyester is preferably from 0° C. to 300° C., and more preferably from 50° C. to 120° C. When the melting point of the crystalline polyester is less than the above-mentioned lower limit, the keeping quality (heat resistance) of the toner is lowered to cause the occurrence of fusion among the toner particles depending on the use environment in some cases. On the other hand, when the melting point of the crystalline polyester exceeds the above-mentioned upper limit, the so-called sharp melt quality is lowered, and the effect of the thermal conglobation treatment might not be sufficiently exhibited.

A3: Coloring Agent

As the coloring agent, there can be used, for example, a pigment or a dye. Such pigments and dyes include, for example, carbon black, spirit black, lamp black (C.I. No. 77266), magnetite, titanium black, chrome yellow, cadmium yellow, mineral fast yellow, navel yellow, Naphthol Yellow S, Hansa Yellow G, Permanent Yellow NCG, chrome yellow, benzidine yellow, quinoline yellow, tartrazine lake, chrome orange, molybdenum orange, Permanent Orange GTR, pyrazolone orange, Benzidine Orange G, cadmium red, Permanent Red 4R, Watchung Red calcium salt, eosin lake, Brilliant Carmine 3B, manganese purple, Fast Violet B, methyl violet lake, Prussian blue, cobalt blue, alkali blue lake, Victoria blue lake, fast sky blue, Indanthrene Blue BC, ultramarine blue, aniline blue, phthalocyanine blue, Calco Oil Blue, chrome green, chromium oxide, Pigment Green B, malachite green lake, phthalocyanine green, Final Yellow Green C, Rhodamine 6G, quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, Nigrosine dye (C.I. No. 50415B), metal complex dyes, silica, aluminum oxide, magnetite, maghemite, various ferrites, metal oxides such as cupric oxide, nickel oxide, zinc oxide, zirconium oxide, titanium oxide and magnesium oxide, and magnetic materials including magnetic metals such as Fe, Co and Ni. They can be used either alone or as a combination of two or more of them.

Although there is no particular limitation on the content of the coloring agent in the raw material 5, it is preferably from 1% to 20% by weight, and more preferably from 3% to 6% by weight. When the content of the coloring agent is less than the above-mentioned lower limit, it might become difficult to form a visible image having sufficient density depending on the type of coloring agent. On the other hand, when the content of the coloring agent exceeds the above-mentioned upper limit, the content of the resin relatively decreases to cause a reduction in fixing ability of the toner on the transfer material such as paper at necessary color density.

A4: Wax

Further, the wax may be contained in the raw material 5 used for production of the toner as needed.

The waxes include, for example, hydrocarbon-based waxes such as ozokerite, sercine, paraffin wax, micro wax, microcrystalline wax, petrolatum and Fischer-Tropsch wax, ester-based waxes such as carnauba wax, rice wax, methyl laurate, methyl myristate, methyl palmitate, methyl stearate, butyl stearate, candelilla wax, cotton wax, Japan tallow, bees wax, lanolin, montan wax and fatty acid esters, olefinic waxes such as polyethylene wax, polypropylene wax, oxidized polyethylene wax and oxidized polypropylene wax, amide-based waxes such as 12-hydroxystearoyl amide, stearoyl amide and anhydrous phthaloyl imide, ketone-based waxes such as laurone and stearone, and ether-based waxes. They may be used either alone or as a combination of two or more of them.

Of the above-mentioned materials, the use of the ester-based waxes provides the following effect.

Similarly to the crystalline polyester described above, the ester-based wax has an ester structure in its molecule, so that it is excellent in compatibility with the crystalline polyester. Further, as described above, the crystalline polyester is also excellent in compatibility with the resin as the main component. Accordingly, the occurrence of free wax in the toner particles finally obtained and coarsening can be effectively prevented (the fine dispersion and micro phase separation of the wax in the toner can be easily achieved). As a result, the toner finally obtained comes to have particularly excellent releasability from the photosensitive member.

Further, of the above-mentioned materials, the use of the olefinic waxes provides the following effect.

Of the above-mentioned materials, the olefinic wax is particularly low in adhesion properties to the photosensitive member, and filming is difficult to occur. For example, therefore, the releasability from the photosensitive member can be improved, scarcely affecting an adverse effect on the transfer efficiency from the photosensitive member.

As described above, the first aspect of the invention has a feature that the crystalline polyester is used as the accessory component, thereby obtaining the effect of improving the transfer efficient. Accordingly, even when the wax is contained in the raw material 5, the content thereof can be decreased. Although there is no particular limitation on the content of the wax in the raw material 5, it is preferably 20% by weight or less, mote preferably 10% by weight or less, and still more preferably from 0.5% to 5% by weight, when the content of the wax is too high, the wax is liberated and coarsened in the toner finally obtained, which cause the wax to significantly ooze to the toner surface. It might therefore become difficult to sufficiently increase the transfer efficiency of the toner.

Although there is no particular limitation on the softening point of the wax, it is preferably from 30° C. to 160° C., and more preferably from 50° C. to 100° C.

A5: Other Components

The raw material 5 may contain components other than the above-mentioned resin, crystalline polyester, coloring agent and wax. Such components include a magnetic powder, an antistatic agent and a dispersing agent.

The magnetic powders include, for example, powders comprising magnetite, maghemite, various ferrites, metal oxides such as cupric oxide, nickel oxide, zinc oxide, zirconium oxide, titanium oxide and magnesium oxide, or magnetic materials containing magnetic metals such as Fe, Co and Ni.

The antistatic agents include, for example, a metal salt of benzoic acid, a metal salt of salicylic acid, a metal salt of an alkylsalicylic acid, a metal salt of catechol, a metal-containing bisazo dye, Nigrosine dye, a tetraphenyl borate derivative, a quaternary ammonium salt, an alkylpyridinium salt, a chlorinated polyester and nitrofumic acid.

The dispersing agents include, for example, a metal soap, an inorganic metal salt, an organic metal salt and polyethylene glycol.

The metal soaps includes a metal salt of tristearic acid (for example, an aluminum salt), a metal salt of distearic acid (for example, an aluminum salt or a barium salt), a metal salt of stearic acid (for example, a calcium salt, a lead salt or a zinc salt), a metal salt of linolenic acid (for example, a cobalt salt, a manganese salt, a lead salt or a zinc salt), a metal salt of octanoic acid (for example, an aluminum salt, a calcium salt or a cobalt salt), a metal salt of oleic acid (for example, a calcium salt or a cobalt salt), a metal salt of palmitic acid (for example, a zinc acid), a metal salt of naphthenic acid (for example, a calcium salt, a cobalt salt, a manganese salt, a lead salt or a zinc salt) and a metal salt of resin acid (for example, a calcium salt, a cobalt salt, a manganese salt, a lead salt or a zinc salt).

The inorganic metal salts and organic metal salts include, for example, a salt containing a cation of an element selected from the group consisting of the group IA metals, the group IIA metals and the group IIIA metals, as a cationic component, and an anion selected from the group consisting of a halogen, a carbonate, an acetate, a sulfate, a borate, a nitrate and a phosphate, as an anionic component.

In addition to the above-mentioned materials, for example, zinc stearate, zinc oxide or cerium oxide may be used as an additive.

Kneading Process

The raw material 5 as described above is kneaded with a kneader 1 as shown in FIG. 1.

As for the raw material 5 subjected to kneading, it is preferred that the respective components described above are previously mixed.

The kneader 1 comprises a processing unit 2 for kneading the raw material 5 while transferring it, a head 3 for forming the kneaded raw material (kneaded material 7) to a specified sectional shape and extruding it, and a feeder 4 for feeding the raw material 5 into the processing unit 2.

The processing unit 2 comprises a barrel 21, screws 22 and 23 inserted in the barrel 21, and a fixing member 24 for fixing the head 3 to a leading end of the barrel 21.

In the processing unit 2, the shearing force is added to the raw material 5 supplied from the feeder 4 by rotation of the screws 22 and 23 to obtain the kneaded material 7 with the above-mentioned respective components sufficiently homogeneously dispersed.

Although the raw material temperature in kneading varies depending on the composition of the raw material 5, it is preferably from 50° C. to 300° C., and more preferably from 100° C. to 200° C.

Extrusion Process

The kneaded material 7 kneaded in the processing unit 2 is extruded to the outside of the kneader 1 through the head 3 by rotation of the screws 22 and 23.

The head 3 comprises an internal space 31 into which the kneaded material 7 is supplied from the processing unit 2, and an extrusion outlet 32 through which the kneaded material 7 is extruded.

In the structure shown in the figure, the internal space 31 has a cross sectional area-decreasing section 33 in which the cross sectional area thereof gradually decreases toward the extrusion outlet 32.

Such a cross sectional area-decreasing section 33 stabilizes the extrusion rate of the kneaded material 7 extruded through the extrusion outlet 32, and further stabilizes the cooling rate of the kneaded material 7 in a cooling process described later. As a result, the toner produced using this is decreased in variations in characteristics among the respective toner particles, so that the toner comes to have excellent characteristics as a whole.

Cooling Process

The kneaded material 7 in a softened state, which has been extruded through the extrusion outlet 32 of the head 3, is cooled and solidified with a cooling device 6.

The cooling device 6 has rolls 61, 62, 63 and 64, and belts 65 and 66.

The belt 65 is put around the rolls 61 and 62. Similarly, the belt 66 is put around the rolls 63 and 64.

The rolls 61, 62, 63 and 64 each rotate in the directions indicated by e, f, g and h, respectively, in the figure, centered on rotating shafts 611, 621, 631 and 641, respectively. The kneaded material 7 extruded through the extrusion outlet 32 of the kneader 1 is introduced between the belts 65 and 66.

The kneaded material 7 introduced between the belts 65 and 66 is cooled while being formed so as to give a tabular shape having an approximately uniform thickness. The kneaded material 7 cooled is discharged from a discharge portion 67. The belts 65 and 66 are cooled by a method such as water cooling or air cooling. When such a belt type device is used as the cooling device, the contact time of the kneaded material extruded from the kneader with the cooling body (belts) can be prolonged, which can allow the cooling efficiency of the kneaded material to become particularly excellent.

Pulverization Process

The kneaded material 7 cooled in the cooling process as described above is pulverized, thereby obtaining a powder for production of the toner.

There is no particular limitation on the pulverization method. Pulverization can be conducted using, for example, various grinding machines such as a ball mill, a vibration mill, a jet mill and pin mill, and crushing machines.

The process of pulverization may be performed in a plurality of stages (for example, two stages of crude pulverization and fine pulverization).

Further, after such a pulverization process, treatment such as classification treatment may be conducted as needed.

For example, a sieve or an airflow type classifier can be used in the classification treatment.

Thermal Conglobation Process (Thermal Conglobation Treatment)

The thermal conglobation treatment is conducted in which the toner-producing powder obtained as described above is heated to conglobate it, thereby obtaining the toner according to the first aspect of the invention.

By conducting such thermal conglobation treatment, relatively large unevenness on a surface of the powder for production of the toner is removed to obtain the toner high in the degree of circularity (having a shape near the complete circle). This decreases the difference in electrostatic characteristics between the respective toner particles, which improves developing properties onto the photosensitive member and prevents more effectively the toner from adhering onto the photosensitive member (filming), resulting in further improvement in the transfer efficiency of the toner.

Now, as described above, the crystalline polyester itself contained in the toner has the effect of improving the transfer efficiency of the toner.

Further, as described above, the crystalline polyester has the sharp melt quality, and also has the function of improving the efficiency of the thermal conglobation treatment. According to the first aspect of the invention, therefore, the degree of circularity of the toner finally obtained can be increased (brought near the complete circle). Further, according to the first aspect of the invention, the conditions of the thermal conglobation can also be made mild.

As described above, the first aspect of the invention has a feature that the effect of containing the crystalline polyester and the effect of conducting the thermal conglobation treatment act synergistically to obtain the particularly excellent effect.

The thermal conglobation treatment can be conducted, for example, by spraying the toner-producing powder obtained in the above-mentioned pulverization process, using compressed air in a heated atmosphere. The atmospheric temperature used at this time is preferably from 150° C. to 500° C., and more preferably from 200° C. to 400° C. When the atmospheric temperature is lower than the above-mentioned lower limit, it becomes difficult to sufficiently increase the degree of circularity of the toner obtained in some cases. On the other hand, when the atmospheric temperature exceeds the above-mentioned upper limit, thermal decomposition and deterioration by oxidation of the materials occur, and coagulation and phase separation are liable to occur, resulting in lessened functions of the toner finally obtained in some cases.

As for the toner (toner powder) obtained by such thermal conglobation treatment, the average degree of circularity R represented by the following equation (I) is preferably 0.92 or more, and more preferably 0.94 or more. When the average degree of circularity R is 0.96 or more, the toner comes to have more excellent transfer efficiency.

$$R=L_0/L_1 \quad \text{(I)}$$

wherein $L_1$ (μm) represents the circumferential length of a projected image of a toner particle to be measured, and $L_0$ (μm) represents the circumferential length of a complete circle (complete geometrical circle) having an area equivalent to that of the projected image of the toner particle to be measured.

The average particle size of the toner obtained as described above is preferably from 2 to 20 μm, and more preferably from 3 to 10 μm. When the average particle size of the toner is smaller than the above-mentioned lower limit, fusion is liable to occur among the toner particles. On the other hand, when the average particle size of the toner exceeds the above-mentioned upper limit, the resolution of printed matter tends to decrease.

Further, the content of the crystalline polyester in the toner is preferably from 1% to 30% by weight, and more preferably from 2% to 15% by weight. When the content of the crystalline polyester is less than the above-mentioned lower limit, the effect of the invention might not be sufficiently obtained on the other hand, when the content of the crystalline polyester exceeds the above-mentioned upper limit, the content of the resin as the main component relatively decreases, and the functions of the resin (for example, good fixing ability in a wide temperature region) might not be sufficiently exhibited.

When the wax is contained in the toner, there is no particular limitation on the content thereof. However, it is preferably 20% by weight or less, more preferably 10% by weight or less, and still more preferably from 0.5% to 5% by weight. When the content of the wax is too high, the wax is liberated and coarsened, which cause the wax to significantly ooze to the toner surface. It might therefore become difficult to sufficiently increase the transfer efficiency of the toner.

After the above-mentioned thermal conglobation process, treatment such as external addition treatment may be conducted as needed.

The external additives include, for example, fine particles comprising an inorganic material such as a metal oxide such as silica, aluminum oxide, titanium oxide, strontium titanate, cerium oxide, magnesium oxide, chromium oxide, titania, zinc oxide, alumina or magnetite, a nitride such as silicon nitride, a carbide such as silicon carbide, or a metal salt such as calcium sulfate or calcium carbonate; fine particles comprising an organic material such as an acrylic resin, a fluororesin, a polystyrene resin, a polyester resin or an aliphatic metal salt; and fine particles comprising a mixture thereof.

Further, the fine particles as described above that are surface treated with HMDS, a silane coupling agent, a titanate coupling agent, a fluorine-containing silane coupling agent or silicone oil may be used as the external additive.

The toner thus obtained is preferably used in a color toner requiring the sharp melt quality or a printer having a fixing device. Such a toner is required to have a relatively high wax content. As a result, such a toner is liable to be adversely affected by the above-mentioned coarsening of the wax particles, and therefore the effect of the invention appears more remarkably.

Although the method for producing a toner and the toner according to the first aspect of the invention have been described above, based on the preferred embodiments, it is to be understood that the scope of the invention is not limited thereto.

In the above-mentioned embodiments, the powder for production of the toner has been described as one obtained by the pulverization process. However, it may be one produced by the polymerization process or other processes.

Further, in the above-mentioned embodiments, the invention has been described referring to a constitution where the thermal conglobation treatment is conducted under dry conditions. However, the thermal conglobation treatment may be conducted, for example, under wet conditions such as in a solution.

Furthermore, in the above-mentioned embodiments, the invention has been described referring to a constitution where the continuous double-screw extruder is used as the kneader. However, the kneader used for kneading of the raw material is not limited thereto. For example, various kneaders such as a kneader, a batch type triaxial roll, a continuous biaxial roll, a wheel mixer and a blade type mixer can be used for kneading of the raw material.

Further, in the structure shown in the figure, the kneader having two screws has been described. However, the kneader may have one screw or three or more screws.

In addition, in the above-mentioned embodiments, the invention has been described referring to a constitution where the belt type cooling device is used as the cooling device. However, for example, a roll type (cooling roll type) cooling device may be used. Further, the cooling of the kneaded material extruded through the extrusion outlet of the kneader is not limited to the use of the cooling device as described above. The kneaded material may also be cooled, for example, by air cooling.

<Second Aspect of the Invention>

Preferred embodiments of the toner production method, the toner and the printed matter according to the second aspect of the invention will be described below in detail with reference to the accompanying drawings.

Constituent Materials

The toner according to the second aspect of the invention is produced using a raw material 5 containing at least a resin (hereinafter may be simply referred to as a "resin") as a main component and a coloring agent.

The respective components of the raw material 5 used for production of the toner according to the second aspect of the invention are described below.

B1: Resin (Binder Resin)

The resin (binder resin) usually has functions of improving adhesion properties of the toner particles to a transfer material such as paper and retaining electrostatic charge of the toner particles.

In the second aspect of the invention, the resin (binder resin) contains at least a polyester resin. The polyester resins include, for example, polyethylene terephthalate (PET), polybutylene terephthalate (PBT), polycyclohexane terephthalate (PCT), polypropylene terephthalate, polyethylene naphthalate and a polyarylate. Of resin materials available as binder resins, the polyester resin is particularly excellent in that it has a functional group such as a carboxyl group or a hydroxyl group, so that characteristics such as the elasticity and the electrostatic property of the toner finally obtained are easily controllable.

In the second aspect of the invention, the resin contains polyester resins different from each other, a first polyester resin and a second polyester resin different from the first polyester resin. The first polyester resin and the second polyester resin are described below in detail.

B1-1: First Polyester Resin

The first polyester resin has a higher softening point than the second polyester resin described later. The first polyester resin having a relatively high softening point is thus contained, whereby the toner finally obtained comes to have excellent stability of form (form stability) to improve its durability.

The softening point of the first polyester resin is preferably from 50° C. to 300° C., and more preferably from 60° C. to 150° C. When the softening point of the first polyester resin is less than the above-mentioned lower limit, the form stability of the toner finally obtained decreases, resulting in the difficulty of obtaining sufficient durability in some cases. On the other hand, when the softening point of the first polyester resin exceeds the above-mentioned upper limit, high temperatures are required in fixing the toner on the transfer material such as paper, which induces a load on a main body of electrophotographic photoreceptor.

The content of the first polyester resin in the raw material 5 is preferably from 50% to 99% by weight, and more preferably from 70% to 95% by weight. When the content of the first polyester resin is less than the above-mentioned lower limit, the form stability of the toner finally obtained decreases to show the tendency of the durability of the toner to decrease. On the other hand, when the content of the first polyester resin exceeds the above-mentioned upper limit, the content of the second polyester resin relatively decreases. When the content of the second polyester resin relatively decreases like this, the transfer efficiency of the toner finally obtained might decrease for a reason as described later.

B1-2: Second Polyester Resin

The second polyester resin has a lower softening point than the first polyester resin. The softening point of the second polyester resin is from 40° C. to 200° C., and more preferably from 50° C. to 120° C. When the softening point of the second polyester resin is less than the above-mentioned lower limit, the keeping quality (heat resistance) of the toner is lowered, for example, to cause the occurrence of fusion among the toner particles depending on the use environment in some cases. On the other hand, when the softening point of the second polyester resin exceeds, the effect of the invention might not be sufficiently obtained.

Further, the second polyester resin is lower in the coefficient of static friction than the first polyester resin. The coefficient of static friction of the first polyester resin and the coefficient of static friction of the second polyester resin shall be measured for comparison under nearly similar surface conditions. The coefficient of static friction of the second polyester resin can be measured, for example, in the following manner. Two members composed of the second polyester resin and having a specified surface state are prepared, and pressed on each other at a specified pressure in an atmosphere of a specified temperature. The coefficient of static friction of the second polyester resin can be determined by measuring the static frictional force in this state. Similarly, the coefficient of static friction of the first polyester resin can also be measured. The relationship between the coefficient of static friction of the first polyester resin and that of the second polyester resin can be confirmed by comparing these values to each other.

As described above, the second polyester resin is lower in the coefficient of static friction and the softening point than the first polyester resin. In other words, when the coefficient of static friction of the first polyester resin is taken as $\mu_1$, the coefficient of static friction of the second polyester resin as $\mu_2$, the softening point of the first polyester resin as $T_{s1}$ (° C.) and the softening point of the second polyester resin as $T_{s2}$ (° C.), the relationship $\mu_1>\mu_2$ and the relationship $T_{s1}>T_{s2}$ are satisfied. The second aspect of the invention has a feature that the toner excellent in transfer efficiency and durability can be obtained by satisfying such relationship. It is considered to be for the following reason that such an effect is obtained.

As described above, the relationship $T_{s1}>T_{s2}$ holds between the first polyester resin and the second polyester resin. Accordingly, the second polyester resin is softened and fused in preference to the first polyester resin in a kneading process or a thermal conglobation process described later, resulting in decreased viscosity. The second polyester resin thus decreased in viscosity reaches a state where a surface of the first polyester resin whose viscosity is kept relatively high is coated therewith. Accordingly, the toner finally obtained comes to have the low frictional properties of the second polyester resin as its surface characteristics. Thus, the decreased frictional drag of the toner particle surface lowers the adhesion properties of the toner to a photosensitive member to improve releasability. As a result, the toner according to the second aspect of the invention comes to have excellent transfer efficiency.

On the other hand, as described above, the first polyester resin having a relatively high softening point is contained in the raw material, so that sufficient form stability is obtained as the whole toner.

Accordingly, the toner finally obtained has the low frictional properties of the second polyester resin as its surface characteristics, and also has sufficient durability as the whole toner. As a result, the toner according to the second aspect of the invention comes to have excellent transfer efficiency and durability.

The content of the second polyester resin in the raw material 5 is preferably from 1% to 50% by weight, and more preferably from 5% to 30% by weight. When the content of the second polyester resin is less than the above-mentioned lower limit, the toner finally obtained shows the tendency of the durability to decrease. On the other hand, when the content of the second polyester resin exceeds the above-mentioned upper limit, the content of the first polyester resin relatively decreases. As a result, the form stability of the toner particles finally obtained decreases, and it might become difficult to sufficiently improve the durability as the toner.

Further, as described above, the second polyester resin mainly has the function of lowering the coefficient of static friction of the toner particle surface. Accordingly, the content of the second polyester resin in the raw material 5 is preferably lower than that of the first polyester resin. That is to say, when the content of the first polyester resin in the raw material 5 is taken as $C_1$ (% by weight) and the content of the second polyester resin as $C_2$ (% by weight), it is preferred that the relationship $C_1>C_2$ is satisfied. By satisfying such relationship, the toner finally obtained comes to have particularly excellent transfer efficiency and durability, and reliability as the whole toner is further improved. Although it is preferred that the relationship $C_1>C_2$ is satisfied in the second aspect of the invention, as described above, it is more preferred that the relationship $0.01<C_2/C_1<1$ is satisfied, and it is still more preferred that the relationship $0.05<C_2/C_1<0.5$ is satisfied. The above-mentioned effect becomes more significant by satisfying such relationship.

Further, the second polyester resin is preferably one having the so-called sharp melt quality. That is to say, the second polyester resin is preferably one having the property that when an endothermic peak of the melting point is measured by differential scanning calorimetric analysis (DSC), the endothermic peak appears as a sharp shape.

When the second polyester resin has the sharp melt quality, the toner particles particularly excellent in the degree of circularity (having a shape near the complete circle) can be obtained in conducting thermal conglobation treatment described later.

Further, by containing the second polyester resin having the sharp melt quality in the raw material 5, it becomes possible to surely fuse the toner particles at relatively low temperatures. That is to say, the transfer efficiency of the toner can be improved.

As an index for indicating the sharp melt quality, there is, for example, the ΔT value represented by $\Delta T=T_{mp}-T_{ms}$, wherein when an endothermic peak of the melting point is measured by differential scanning calorimetric analysis (DSC), the center value of the peak is taken as $T_{mp}$ (° C.) and the shoulder peak value is taken as $T_{ms}$ (° C.) (refer to FIG. 2). The lower this ΔT value is, the higher the sharp melt quality is.

The ΔT value of the second polyester resin is preferably 30° C. or less, and more preferably 15° C. or less. The measuring conditions of $T_{mp}$ (° C.) and $T_{ms}$ (° C.) are described below. That is, they are measured by elevating the temperature of a second polyester resin sample to 300° C. at a rate of temperature rise of 10° C./minute, further lowering it at a rate of temperature decrease of 10° C./minute, and then elevating it at a rate of temperature rise of 10° C./minute.

Further, the melting point of the second polyester resin is preferably from 40° C. to 200° C., and more preferably from 50° C. to 120° C. When the melting point of the second polyester resin is less than the above-mentioned lower limit, the keeping quality (heat resistance) of the toner is lowered to cause the occurrence of fusion among the toner particles depending on the use environment in some cases. On the other hand, when the melting point of the second polyester resin exceeds the above-mentioned upper limit, the second polyester resin becomes difficult to appear on the toner particle surface, resulting in the possibility of failure to sufficiently obtain the effect of the invention.

Further, the second polyester resin has high strength, compared to wax that has hitherto been used for improving releasability. In the invention, therefore, the strength is improved as the whole toner, and the toner comes to have particularly excellent durability.

The second polyester resin is preferably a linear type polymer. The linear type polyester can be more decreased in the coefficient of static friction, compared to a crosslinking type polyester. This provides particularly excellent releasability to further improve the transfer efficiency of the toner.

Further, the second polyester resin is preferably one containing an aliphatic carboxylic acid as an acid component, more preferably, one in which almost all (for example, 80% by weight or more based on the whole acid component) of the acid component is an aliphatic carboxylic acid, and still more preferably, one in which the acid component is substantially all composed of an aliphatic carboxylic acid. This makes it possible to more decrease the coefficient of static friction of the toner. As a result, the toner comes to have particularly excellent transfer efficiency.

Furthermore, the second polyester resin is preferably one containing an aliphatic alcohol as an alcohol component, more preferably, one in which almost all (for example, 80% by weight or more based on the whole alcohol component) of the alcohol component is an aliphatic alcohol, and still more preferably, one in which the alcohol component is substantially all composed of an aliphatic alcohol. This makes it possible to more decrease the coefficient of static friction of the toner. As a result, the toner comes to have particularly excellent transfer efficiency.

Although there is no particular limitation on the content of the resin in the raw material 5, it is preferably from 51% to 99% by weight, and more preferably from 70% to 98% by weight. When the content of the resin is less than the above-mentioned lower limit, the functions of the resin (for example, good fixing ability in a wide temperature region) might not be sufficiently exhibited. On the other hand, when the content of the resin exceeds the above-mentioned upper limit, a large amount of toner becomes necessary for obtaining necessary color density, resulting in the difficulty of printing in some cases.

The resin may contain at least one component (third resin component) different from the above-mentioned first polyester component and second polyester component.

Examples of the third resin components include a styrenic resin, or a homopolymer or a copolymer containing styrene or a styrene-substituent component, such as polystyrene, poly-α-methylstyrene, polychlorostyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer, a styrene-methacrylate copolymer, a styrene-acrylate-methacrylate copolymer, a styrene-methyl α-chloroacrylate copolymer, a styrene-acrylonitrile-acrylate copolymer or a styrene-vinyl methyl ether copolymer, a polyester resin (having a composition and/or a molecular weight different from that of the above-mentioned first polyester composition and second polyester composition), an epoxy resin, a urethane-modified epoxy resin, a silicone-modified epoxy resin, a vinyl chloride resin, a rosin-modified epoxy resin, a phenyl resin, polyethylene, polypropylene, an ionomer resin, a polyurethane resin, a silicone resin, a ketone resin, an ethylene-ethyl acrylate copolymer, a xylene resin, a polyvinyl butyral resin, a terpene resin, a phenol resin and an aliphatic or alicyclic hydrocarbon resin. They can be used either alone or as a combination of two or more of them.

B2: Coloring Agent

As the coloring agent, there can be used, for example, a pigment or a dye. Such pigments and dyes include, for example, carbon black, spirit black, lamp black (C.I. No. 77266), magnetite, titanium black, chrome yellow, cadmium yellow, mineral fast yellow, navel yellow, Naphthol Yellow S, Hansa Yellow G, Permanent Yellow NCG, chrome yellow, benzidine yellow, quinoline yellow, tartrazine lake, chrome orange, molybdenum orange, Permanent Orange GTR, pyrazolone orange, Benzidine Orange G, cadmium red, Permanent Red 4R, Watchung Red calcium salt, eosin lake, Brilliant Carmine 3B, manganese purple, Fast Violet B, methyl violet lake, Prussian blue, cobalt blue, alkali blue lake, Victoria blue lake, fast sky blue, Indanthrene Blue BC, ultramarine blue, aniline blue, phthalocyanine blue, Calco Oil Blue, chrome green, chromium oxide, Pigment Green B, malachite green lake, phthalocyanine green, Final Yellow Green G, Rhodamine 6G, quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, Nigrosine dye (C.I. No. 50415B), metal complex dyes, silica, aluminum oxide, magnetite, maghemite, various ferrites, metal oxides such as cupric oxide, nickel oxide, zinc oxide, zirconium oxide, titanium oxide and magnesium oxide, and magnetic materials including magnetic metals such as Fe, Co and Ni. They can be used either alone or as a combination of two or more of them.

Although there is no particular limitation on the content of the coloring agent in the raw material 5, it is preferably from 1% to 20% by weight, and more preferably from 3% to 6% by weight. When the content of the coloring agent is less than the above-mentioned lower limit, it might become difficult to form a visible image having sufficient density depending on the type of coloring agent. On the other hand, when the content of the coloring agent exceeds the above-mentioned upper limit, the content of the resin relatively decreases to cause a reduction in fixing ability of the toner on the transfer material such as paper at necessary color density.

B3: Wax

Further, the wax may be contained in the raw material 5 used for production of the toner as needed. This can further improve the transfer efficiency of the toner.

As described above, the second aspect of the invention has a feature that the first polyester resin and the second polyester resin are used, thereby obtaining the sufficient transfer efficiency and durability. Accordingly, even when the wax is contained in the raw material 5, it is preferred that the content thereof is relatively small. Although there is no particular limitation on the content of the wax in the raw material 5, it is preferably, for example, 10% by weight or less, more preferably 5% by weight or less, and still more preferably from 1% to 3% by weight. When the content of the wax is too high, the wax is liberated and coarsened in the toner finally obtained, which cause the wax to significantly ooze to the toner surface. It might therefore become difficult to sufficiently increase the transfer efficiency of the toner.

The waxes include, for example, hydrocarbon-based waxes such as ozokerite, sercine, paraffin wax, micro wax, microcrystalline wax, petrolatum and Fischer-Tropsch wax, ester-based waxes such as carnauba wax, rice wax, methyl laurate, methyl myristate, methyl palmitate, methyl stearate, butyl stearate, candelilla wax, cotton wax, Japan tallow, bees wax, lanolin, montan wax and fatty acid esters, olefinic waxes such as polyethylene wax, polypropylene wax, oxidized polyethylene wax and oxidized polypropylene wax, amide-based waxes such as 12-hydroxystearoyl amide, stearoyl amide and anhydrous phthaloyl imide, ketone-based waxes such as laurone and stearone, and ether-based waxes.

They may be used either alone or as a combination of two or more of them. Of the above-mentioned materials, the use of the ester-based waxes provides the following effect.

Similarly to the first polyester resin and second polyester resin described above, the ester-based wax has an ester structure in its molecule, so that it is excellent in compatibility with the first polyester resin and second polyester resin. Accordingly, the occurrence of free wax in the toner particles finally obtained and coarsening can be effectively prevented (the fine dispersion and micro phase separation of the wax in the toner can be easily achieved). As a result, the toner finally obtained comes to have particularly excellent releasability from the photosensitive member.

Although there is no particular limitation on the softening point of the wax, it is preferably from 0° C. to 100° C., and more preferably from 50° C. to 90° C.

B4: Other Components

The raw material 5 may contain components other than the above-mentioned first polyester resin, second polyester resin, coloring agent and wax. Such components include a magnetic powder, an antistatic agent and a dispersing agent.

The magnetic powders include, for example, powders comprising magnetite, maghemite, various ferrites, metal oxides such as cupric oxide, nickel oxide, zinc oxide, zirconium oxide, titanium oxide and magnesium oxide, or magnetic materials containing magnetic metals such as Fe, Co and Ni.

The antistatic agents include, for example, a metal salt of benzoic acid, a metal salt of salicylic acid, a metal salt of an alkylsalicylic acid, a metal salt of catechol, a metal-containing bisazo dye, Nigrosine dye, a tetraphenyl borate derivative, a quaternary ammonium salt, an alkylpyridinium salt, a chlorinated polyester and nitrofumic acid.

The dispersing agents include, for example, a metal soap, an inorganic metal salt, an organic metal salt and polyethylene glycol.

The metal soaps includes a metal salt of tristearic acid (for example, an aluminum salt), a metal salt of distearic acid (for example, an aluminum salt or a barium salt), a metal salt of stearic acid (for example, a calcium salt, a lead salt or a zinc salt), a metal salt of linolenic acid (for example, a cobalt salt, a manganese salt, a lead salt or a zinc salt), a metal salt of octanoic acid (for example, an aluminum salt, a calcium salt or a cobalt salt), a metal salt of oleic acid (for example, a calcium salt or a cobalt salt), a metal salt of palmitic acid (for example, a zinc acid), a metal salt of naphthenic acid (for example, a calcium salt, a cobalt salt, a manganese salt, a lead salt or a zinc salt) and a metal salt of resin acid (for example, a calcium salt, a cobalt salt, a manganese salt, a lead salt or a zinc salt).

The inorganic metal salts and organic metal salts include, for example, a salt containing a cation of an element selected from the group consisting of the group IA metals, the group IIA metals and the group IIIA metals, as a cationic component, and an anion selected from the group consisting of a halogen, a carbonate, an acetate, a sulfate, a borate, a nitrate and a phosphate, as an anionic component.

In addition to the above-mentioned materials, for example, zinc stearate, zinc oxide or cerium oxide may be used as an additive.

Kneading Process

The raw material 5 as described above is kneaded with a kneader 1 as shown in FIG. 1.

As for the raw material 5 subjected to kneading, it is preferred that the respective components described above are previously mixed.

The kneader 1 comprises a processing unit 2 for kneading the raw material 5 while transferring it, a head 3 for forming the kneaded raw material (kneaded material 7) to a specified sectional shape and extruding it, and a feeder 4 for feeding the raw material 5 into the processing unit 2.

The processing unit 2 comprises a barrel 21, screws 22 and 23 inserted in the barrel 21, and a fixing member 24 for fixing the head 3 to a leading end of the barrel 21.

In the processing unit 2, the shearing force is added to the raw material 5 supplied from the feeder 4 by rotation of the screws 22 and 23 to obtain the kneaded material 7 with the above-mentioned respective components sufficiently homogeneously dispersed.

Although the raw material temperature in kneading varies depending on the composition of the raw material 5, it is preferably from 50° C. to 300° C., and more preferably from 100° C. to 200° C. When the raw material temperature is less than the above-mentioned lower limit, the viscosity of the raw material 5 increases, resulting in the difficulty of sufficiently homogeneously kneading the raw material. On the other hand, when the raw material temperature exceeds the above-mentioned upper limit, thermal decomposition and deterioration by oxidation of the materials occur, and coagulation and phase separation are liable to occur, resulting in lessened functions of the toner finally obtained in some cases.

Extrusion Process

The kneaded material 7 kneaded in the processing unit 2 is extruded to the outside of the kneader 1 through the head 3 by rotation of the screws 22 and 23.

The head 3 comprises an internal space 31 into which the kneaded material 7 is supplied from the processing unit 2, and an extrusion outlet 32 through which the kneaded material 7 is extruded.

In the structure shown in the figure, the internal space 31 has a cross sectional area-decreasing section 33 in which the cross sectional area thereof gradually decreases toward the extrusion outlet 32.

Such a cross sectional area-decreasing section 33 stabilizes the extrusion rate of the kneaded material 7 extruded through the extrusion outlet 32, and further stabilizes the cooling rate of the kneaded material 7 in a cooling process described later. As a result, the toner produced using this is decreased in variations in characteristics among the respective toner particles, so that the toner comes to have excellent characteristics as a whole.

Cooling Process

The kneaded material 7 in a softened state, which has been extruded through the extrusion outlet 32 of the head 3, is cooled and solidified with a cooling device 6.

The cooling device 6 has rolls 61, 62, 63 and 64, and belts 65 and 66.

The belt 65 is put around the rolls 61 and 62. Similarly, the belt 66 is put around the rolls 63 and 64.

The rolls 61, 62, 63 and 64 each rotate in the directions indicated by e, f, g and h, respectively, in the figure, centered on rotating shafts 611, 621, 631 and 641, respectively. The kneaded material 7 extruded through the extrusion outlet 32 of the kneader 1 is introduced between the belts 65 and 66. The kneaded material 7 introduced between the belts 65 and 66 is cooled while being formed so as to give a tabular shape having an approximately uniform thickness. The kneaded material 7 cooled is discharged from a discharge portion 67. The belts 65 and 66 are cooled by a method such as water cooling or air cooling. When such a belt type device is used as the cooling device, the contact time of the kneaded material extruded from the kneader with the cooling body (belts) can be prolonged, which can allow the cooling efficiency of the kneaded material to become particularly excellent.

Pulverization Process

The kneaded material 7 cooled in the cooling process as described above is pulverized, thereby obtaining a powder for production of the toner.

There is no particular limitation on the pulverization method. Pulverization can be conducted using, for example, various grinding machines such as a ball mill, a vibration mill, a jet mill and pin mill, and crushing machines.

The process of pulverization may be performed in a plurality of stages (for example, two stages of crude pulverization and fine pulverization).

Further, after such a pulverization process, treatment such as classification treatment may be conducted as needed.

For example, a sieve or an airflow type classifier can be used in the classification treatment.

Thermal Conglobation Process (Thermal Conglobation Treatment)

A thermal conglobation treatment may be conducted in which the toner-producing powder obtained as described above is heated to conglobate it.

By conducting such thermal conglobation treatment, relatively large unevenness on a surface of the powder for production of the toner is removed to obtain the toner high in the degree of circularity (having a shape near the complete circle). This decreases the difference in electrostatic characteristics between the respective toner particles, which improves developing properties onto the photosensitive member and prevents more effectively the toner from adhering onto the photosensitive member (filming), resulting in further improvement in the transfer efficiency of the toner.

Now, as described above, the second polyester resin itself contained in the toner has the effect of improving the transfer efficiency of the toner.

Further, as described above, the second polyester resin has the sharp melt quality, and also has the function of improving the efficiency of the thermal conglobation treatment. According to the second aspect of the invention, therefore, the degree of circularity of the toner finally obtained can be increased (brought near the complete circle). Further, according to the second aspect of the invention, the conditions of the thermal conglobation can also be made mild.

As described above, when the thermal conglobation treatment is conducted, the effect of this thermal conglobation treatment acts synergistically with the effect of containing the second polyester resin, and the resulting toner comes to have particularly excellent transfer efficiency.

The thermal conglobation treatment can be conducted by spraying the toner-producing powder obtained in the above-mentioned pulverization process, using compressed air in a heated atmosphere. The atmospheric temperature used at this time is preferably from 150° C. to 500° C., and more preferably from 200° C. to 400° C. When the atmospheric temperature is lower than the above-mentioned lower limit, it becomes difficult to sufficiently increase the degree of circularity of the toner obtained in some cases. On the other hand, when the atmospheric temperature exceeds the above-mentioned upper limit, thermal decomposition and deterioration by oxidation of the materials occur, and coagulation and phase separation are liable to occur, resulting in lessened functions of the toner finally obtained in some cases.

As for the toner (toner powder), the average degree of circularity R represented by the following equation (I) is preferably 0.92 or more, and more preferably 0.95 or more. When the average degree of circularity R is 0.96 or more, the toner comes to have more excellent transfer efficiency.

$$R=L_0/L_1 \quad \text{(I)}$$

wherein $L_1$ (μm) represents the circumferential length of a projected image of a toner particle to be measured, and $L_0$ (μm) represents the circumferential length of a complete circle (complete geometrical circle) having an area equivalent to that of the projected image of the toner particle to be measured.

The average particle size of the toner obtained as described above is preferably from 2 to 20 μm, and more preferably from 5 to 10 μm. When the average particle size of the toner is smaller than the above-mentioned lower limit, fusion is liable to occur among the toner particles. On the other hand, when the average particle size of the toner exceeds the above-mentioned upper limit, the resolution of printed matter tends to decrease.

Further, the content of the second polyester resin in the toner is preferably from 1% to 50% by weight, and more preferably from 5% to 30% by weight. When the content of the second polyester resin is less than the above-mentioned lower limit, the effect of the invention might not be sufficiently obtained. On the other hand, when the content of the second polyester resin exceeds the above-mentioned upper limit, the content of the resin as the main component relatively decreases, and the functions of the resin (for example, good fixing ability in a wide temperature region) might not be sufficiently exhibited.

When the wax is contained in the toner, there is no particular limitation on the content thereof. However, it is preferably 10% by weight or less, more preferably 5% by weight or less, and still more preferably from 1% to 3% by weight. When the content of the wax is too high, the wax is liberated and coarsened, which cause the wax to significantly ooze to the toner surface. It might therefore become difficult to sufficiently increase the transfer efficiency of the toner.

After the above-mentioned thermal conglobation process, treatment such as external addition treatment may be conducted as needed.

The external additives include, for example, fine particles comprising an inorganic material such as a metal oxide such as silica, aluminum oxide, titanium oxide, strontium titanate, cerium oxide, magnesium oxide, chromium oxide, titania, zinc oxide, alumina or magnetite, a nitride such as silicon nitride, a carbide such as silicon carbide, or a metal salt such as calcium sulfate or calcium carbonate; fine particles comprising an organic material such as an acrylic resin, a fluororesin, a polystyrene resin, a polyester resin or an aliphatic metal salt; and fine particles comprising a mixture thereof.

Further, the fine particles as described above that are surface treated with HMDS, a silane coupling agent, a titanate coupling agent, a fluorine-containing silane coupling agent or silicone oil may be used as the external additive.

The toner thus obtained is preferably used in a color toner requiring the sharp melt quality or a printer having a fixing device. Such a toner is required to have a relatively high wax content. As a result, such a toner is liable to be adversely affected by the above-mentioned coarsening of the wax particles, and therefore the effect of the invention appears more remarkably.

Printed Matter

The printed matter of the invention will be described below.

The printed matter of the invention is one printed using the toner described above (including reproduction with a copy machine).

Base materials on which prints are made include, for example, paper materials such as plain paper, glassine paper, quality paper, coated paper, dust-free paper, synthetic paper and recycled paper.

The print may be made on a surface of the base material as described above either directly or with the interposition of a foundation layer provided on the surface of the base material.

The print is usually made on the base material with an electrophotographic apparatus such as a laser printer.

As described above, the toner according to the second aspect of the invention is excellent in transfer efficiency and durability. Accordingly, the printed matter according to the second aspect of the invention becomes clear printed matter decreased in fogging and offset.

Further, as described above, the toner according to the second aspect of the invention provides the sufficient transfer efficiency, so that the wax may not be contained, or may be contained in relatively small amounts. When the toner does not contain the wax or contains the wax in relatively small amounts as described above, the printed matter printed using the toner becomes easily writable on a printed area with a writing tool such as a ball pen, a pencil or a highlight pen.

Although the method for producing a toner, the toner and the printed matter according to the second aspect of the invention have been described above, based on the preferred embodiments, it is to be understood that the scope of the invention is not limited thereto.

For example, in the above-mentioned embodiments, the thermal conglobation treatment of conglobating the powder for production of the toner obtained in the pulverization process has been conducted. However, the powder for production of the toner may be used as the toner as such without the thermal conglobation treatment.

In the above-mentioned embodiments, the powder for production of the toner has been described referring to one obtained through the pulverization process. However, it may be one produced by the polymerization process or other processes.

Further, in the above-mentioned embodiments, the invention has been described referring to a constitution where the thermal conglobation treatment is conducted under dry conditions. However, the thermal conglobation treatment may be conducted, for example, under wet conditions such as in a solution.

Furthermore, in the above-mentioned embodiments, the invention has been described referring to a constitution where the continuous double-screw extruder is used as the kneader. However, the kneader used for kneading of the raw material is not limited thereto. For example, various kneaders such as a kneader, a batch type triaxial roll, a continuous biaxial roll, a wheel mixer and a blade type mixer can be used for kneading of the raw material.

Further, in the structure shown in the FIGURE, the kneader having two screws has been described. However, the kneader may have one screw or three or more screws.

In addition, in the above-mentioned embodiments, the invention has been described referring to a constitution where the belt type cooling device is used as the cooling device. However, for example, a roll type (cooling roll type) cooling device may be used. Further, the cooling of the kneaded material extruded through the extrusion outlet of the kneader is not limited to the use of the cooling device as described above. The kneaded material may also be cooled, for example, by air cooling.

EXAMPLES

The present invention will be illustrated in greater detail with reference to the following Examples, but the invention should not be construed as being limited thereto.

(A1) Production of Resin (Binder Resin) and Crystalline Polyesters

Prior to the production of toners, three types of polyesters A, B and C shown below were produced.

(A1.1) Production of Polyester A

A hundred grams of a bisphenol A-propylene oxide addition product as an alcohol component and 100 g of terephthalic acid as an acid component were prepared. These were reacted with each other in a flask equipped with a nitrogen-introducing pipe and a dewatering pipe at 200° C. for 6 hours. Then, the atmospheric pressure was increased to 8 kPa, and the reaction was further continued for 1 hour. The resulting reaction product was called as polyester A (PES-A).

For polyester A thus obtained, it was attempted to measure the endothermic peak of the melting point with a differential scanning calorimetric analyzer (DSC210, manufactured by Seiko Instruments Inc.). The endothermic peak of the melting point was measured by elevating the temperature of a sample of polyester A to 300° C. at a rate of temperature rise of 10° C./minute, further lowering it to 20° C. at a rate of temperature decrease of 10° C./minute, and then elevating it at a rate of temperature rise of 10° C./minute. As a result, a sharp peak that can be judged to be the endothermic peak of the melting point could not be confirmed. The measured value of the glass transition point Tg (° C.) of polyester A was 58° C.

(A1.2) Production of Polyester B

A hundred grams of propylene glycol as an alcohol component and 100 g of terephthalic acid as an acid component were prepared. These were reacted with each other in a flask equipped with a nitrogen-introducing pipe and a dewatering pipe at 200° C. for 6 hours. Then, the atmospheric pressure was increased to 8 kPa, and the reaction was further continued for 1 hour. The resulting reaction product was called as polyester B (PES-B).

For polyester B thus obtained, the endothermic peak of the melting point was measured with a differential scanning calorimetric analyzer (DSC210, manufactured by Seiko Instruments Inc.). The endothermic peak of the melting point was measured by elevating the temperature of a sample of polyester B to 300° C. at a rate of temperature rise of 10° C./minute, further lowering it to 20° C. at a rate of temperature decrease of 10° C./minute, and then elevating it at a rate of temperature rise of 10° C./minute. The center value $T_{mp}$ of the endothermic peak of the melting point was 85° C., and the shoulder peak value $T_{ms}$ was 68° C. From a differential scanning calorimetric analysis curve obtained by the measurement, the heat of fusion $E_f$ (mJ/mg) was determined. As a result, the heat of fusion $E_f$ of polyester B was 15.3 mJ/mg.

(A1.3) Production of Polyester C

A hundred grams of propylene glycol as an alcohol component and 100 g of maleic acid as an acid component were prepared. These were reacted with each other in a flask equipped with a nitrogen-introducing pipe and a dewatering pipe at 200° C. for 6 hours. Then, the atmospheric pressure was increased to 8 kPa, and the reaction was further continued for 1 hour. The resulting reaction product was called as polyester C (PES-C).

For polyester C thus obtained, the endothermic peak of the melting point was measured with a differential scanning calorimetric analyzer (DSC210, manufactured by Seiko Instruments Inc.). The endothermic peak of the melting point was measured by elevating the temperature of a sample of polyester C to 300° C. at a rate of temperature rise of 10° C./minute, further lowering it to 20° C. at a rate of temperature decrease of 10° C./minute, and then elevating it at a rate of temperature rise of 10° C./minute. The center value $T_{mp}$ of the endothermic peak of the melting point was 72° C., and the shoulder peak value $T_{ms}$ was 63° C. From a differential scanning calorimetric analysis curve obtained by the measurement, the heat of fusion $E_f$ (mJ/mg) was determined. As a result, the heat of fusion $E_f$ of polyester B was 43.5 mJ/mg.

(A2) Production of Toners

Toners were produced as described below.

Example A1

First, 100 parts by weight of polyester A as a resin (binder resin), 10 parts by weight of polyester B as a crystalline polyester, 5 parts by weight of a copper phthalocyanine pigment as a coloring agent and 1 part by weight of a chromium salicylate complex as an antistatic agent were prepared.

These respective components were mixed by the use of a Henschel mixer to obtain a raw material for production of a toner.

Then, this raw material (mixture) was kneaded with a double-screw extruder as described in FIG. 1. The material temperature in kneading was 150° C.

The kneaded material extruded through an extrusion outlet of the kneader was cooled with a cooling device as shown in FIG. 1.

The kneaded material cooled as described above was crudely pulverized (average particle size: 1 to 2 mm), and subsequently finely pulverized. A hammer mill was used for the crude pulverization of the kneaded material, and a jet mill was used for the fine pulverization of the kneaded material.

The pulverized material thus obtained was classified with an airflow type size classifier.

Then, thermal conglobation treatment was conducted on the pulverized material classified (the powder for production of a toner). The thermal conglobation treatment was conducted by the use of a thermal conglobation apparatus (Type SFS3, manufactured by Nippon Pneumatic Mfg. Co., Ltd.). The atmospheric temperature in the thermal conglobation treatment was 300° C. Then, 1.2 parts by weight of silica was mixed by the use of a Henschel mixer with 100 parts by weight of the powder on which the thermal conglobation treatment was conducted to obtain a toner. The average particle size of the toner finally obtained was 8.0 μm.

Example A2

A toner was produced in the same manner as in Example A1 with the exception that polyester C was used as the crystalline polyester.

Examples A3 to A5

Toners were produced in the same manner as in Example A2 with the exception that the compounding ratio of the respective components in the raw material was changed as shown in Table A1.

Example A6

A toner was produced in the same manner as in Example A1 with the exception that 2 parts by weight of carnauba wax (an ester-based wax) was added to the raw material used for production of the toner.

Example A7

A toner was produced in the same manner as in Example A2 with the exception that 2 parts by weight of polyethylene wax (an olefinic wax) was added to the raw material used for production of the toner.

Example A8

A toner was produced in the same manner as in Example A2 with the exception that a mixture of 60 parts by weight of polyester A and 40 parts by weight of a styrene-acrylic resin (S-LEC P, manufactured by Sekisui Chemical Co., Ltd.) was used as the resin (binder resin).

Example A9

A toner was produced in the same manner as in Example A2 with the exception that 100 parts by weight of a styrene-acrylic resin (S-LEC P, manufactured by Sekisui Chemical Co., Ltd.) was used as the resin (binder resin), Comparative Example A1

A toner was produced in the same manner as in Example A1 with the exception that 110 parts by weight of polyester A, 5 parts by weight of the copper phthalocyanine pigment as the coloring agent and 1 part by weight of the chromium salicylate complex as the antistatic agent were used as the raw material for production of the toner.

Comparative Example A2

A toner was produced in the same manner as in Example A1 with the exception that 110 parts by weight of polyester C, 5 parts by weight of the copper phthalocyanine pigment as the coloring agent and 1 part by weight of the chromium salicylate complex as the antistatic agent were used as the raw material for production of the toner.

Comparative Example A3

A toner was produced in the same manner as in Example A1 with the exception that 110 parts by weight of polyester A, 15 parts by weight of carnauba wax, 5 parts by weight of the copper phthalocyanine pigment as the coloring agent and 1 part by weight of the chromium salicylate complex as the antistatic agent were used as the raw material for production of the toner.

Comparative Example A4

A toner was produced in the same manner as in Example A1 with the exception that the thermal conglobation treatment process was omitted.

The raw materials used for production of the toners and toner conditions are summarized in Table A1. In Table A1, polyester A, polyester B and polyester C are indicated by PES-A, PES-B and PES-C, respectively, the styrene-acrylic resin is indicated by StAc, and the antistatic agent is indicated by CCA.

TABLE A1

| | Raw Material | | | | | | | | | | |
|---|---|---|---|---|---|---|---|---|---|---|---|
| | Resin | | Crystalline Polyester | | Wax | | Coloring Agent | CCA | Toner | | |
| | Type | Content parts by weight | Type | Content parts by weight | Type | Content parts by weight | Content parts by weight | Content parts by weight | Crystalline Polyester Content (wt %) | Wax Content (wt %) | Average Particle Size (μm) |
| Example A1 | PES-A | 100 | PES-B | 10 | — | — | 5 | 1 | 8.6 | — | 8.0 |
| Example A2 | PES-A | 100 | PES-C | 10 | — | — | 5 | 1 | 8.6 | — | 8.0 |
| Example A3 | PES-A | 95 | PES-C | 15 | — | — | 5 | 1 | 12.9 | — | 8.0 |
| Example A4 | PES-A | 90 | PES-C | 20 | — | — | 5 | 1 | 17.2 | — | 8.0 |
| Example A5 | PES-A | 80 | PES-C | 30 | — | — | 5 | 1 | 25.9 | — | 8.0 |
| Example A6 | PES-A | 100 | PES-B | 10 | Ester | 2 | 5 | 1 | 8.5 | 1.7 | 8.0 |
| Example A7 | PES-A | 100 | PES-C | 10 | Olefin | 2 | 5 | 1 | 8.5 | 1.7 | 8.0 |
| Example A8 | PES-A<br>StAc | 60<br>40 | PES-C | 10 | — | — | 5 | 1 | 8.6 | — | 8.0 |
| Example A9 | StAc | 100 | PES-C | 10 | — | — | 5 | 1 | 8.6 | — | 8.0 |
| Comparative Example A1 | PES-A | 110 | — | — | — | — | 5 | 1 | — | — | 8.0 |
| Comparative Example A2 | — | — | PES-C | 110 | — | — | 5 | 1 | 94.8 | — | 8.0 |
| Comparative Example A3 | PES-A | 110 | — | — | Ester | 15 | 5 | 1 | — | 11.5 | 8.0 |
| Comparative Example A4 | PES-A | 100 | PES-B | 10 | — | — | 5 | 1 | 8.6 | — | 8.0 |

(A3) Evaluations

For each toner obtained as described above, evaluations of the average degree of circularity of the toner particles, the transfer efficiency and the fixing temperature region were made.

(A3.1) Average Degree of Circularity

For the toners produced in Examples and Comparative Examples described above, the average degree of circularity R was measured. The degree of circularity was measured in an aqueous dispersion system with a flow type particle image analyzer (FPIA-2000, manufactured by SYSMEX Corporation). The degree of circularity R is represented by the following equation (I):

$$R=L_0/L_1 \quad \text{(I)}$$

wherein $L_1$ (μm) represents the circumferential length of a projected image of a toner particle to be measured, and $L_0$ (μm) represents the circumferential length of a complete circle having an area equivalent to that of the projected image of the toner particle to be measured.

(A3.2) Measurement of Transfer Efficiency

A cartridge of a color laser printer (LP-3000C, manufactured by Seiko Epson Corporation) was refilled with each of the toners produced in Examples and Comparative Examples described above, and a pattern for evaluation was printed on a color laser printer sheet (high quality plain paper, manufactured by Seiko Epson Corporation). The ratio of the toner weight on a photosensitive member just after the development process (before the transfer) to the toner weight on the photosensitive member after the transfer (after the printing) was determined as the transfer efficiency.

(A3.3) Fixing Temperature Region

A cartridge of a color laser printer (LP-3000C, manufactured by Seiko Epson Corporation) was refilled with each of the toners produced in Examples and Comparative Examples described above. The fixing temperature of a fixing roll of a fixing device was variously changed, and patterns for evaluation were printed on color laser printer sheets (high quality plain paper, manufactured by Seiko Epson Corporation). The temperature width of a temperature region within which offset did not occur on the print patterns printed on the sheets was taken as the fixing temperature region.

The results of these are summarized in Table A2.

TABLE A2

| | Average Degree of Circularity | Transfer Efficiency (%) | Fixing Temperature Region (° C.) |
|---|---|---|---|
| Example A1 | 0.957 | 97 | 120-170 |
| Example A2 | 0.963 | 97 | 110-170 |
| Example A3 | 0.970 | 98 | 110-180 |
| Example A4 | 0.972 | 98 | 110-160 |
| Example A5 | 0.978 | 99 | 110-150 |
| Example A6 | 0.973 | 99 | 100-200 |
| Example A7 | 0.972 | 99 | 110-220 |
| Example A8 | 0.962 | 97 | 120-170 |
| Example A9 | 0.964 | 97 | 120-170 |
| Comparative Example A1 | 0.936 | 92 | 150-160 |
| Comparative Example A2 | 0.982 | 98 | 100-120 |
| Comparative Example A3 | 0.975 | 81 | 100-200 |

TABLE A2-continued

| | Average Degree of Circularity | Transfer Efficiency (%) | Fixing Temperature Region (° C.) |
|---|---|---|---|
| Comparative Example A4 | 0.912 | 89 | 120-170 |

As apparent from Table A2, the toners of the invention were all high in the average degree of circularity (low in roundness), and excellent in the transfer efficiency. Further, good fixing quality was obtained in the wide temperature region, and the occurrence of an adverse effect such as offset was effectively prevented. In particular, the toners in which the crystalline polyester content was within the preferred range provided extremely excellent results. Furthermore, it is revealed that addition of a small amount of wax results in the more excellent transfer efficiency.

In contrast, the toners obtained in Comparative Examples A1 and A4 were low in the average degree of circularity, and poor in the transfer efficiency.

Further, the toner obtained in Comparative Example A3 was high in the average degree of circularity. However, a large amount of wax oozed out to surfaces of the toner particles, and the transfer efficiency of the toner was extremely low.

Furthermore, the toner obtained in Comparative Example A2 was relatively excellent in the transfer efficiency of the toner. However, the fixing temperature region was extremely narrow, so that the toner was not developed to a practical level.

In addition, toners were prepared in the same manner as in Examples and Comparative Examples described above with the exception that Pigment Red 57:1, C.I. Pigment Yellow 93 and carbon black were used as the coloring agent in place of the copper phthalocyanine pigment, and evaluated in the same manner as describe above. As a result, results similar to those of Examples and Comparative Examples described above were obtained.

As described above, according to the invention, the toner excellent in the transfer efficiency can be provided.

Such an advantage can be further improved by controlling the composition of the resin used as the main component, the composition of the crystalline polyester used as the accessory component, and the compounding ratio thereof.

(B1) Production of Polyester Resins Used as Resins (Binder Resins)

Prior to the production of toners, four types of polyesters A, B, C and D shown below were produced.

(B1.1) Production of Polyester A

A hundred grams of a bisphenol A-propylene oxide addition product as an alcohol component and 100 g of terephthalic acid as an acid component were prepared. These were reacted with each other in a flask equipped with a nitrogen-introducing pipe and a dewatering pipe at 200° C. for 6 hours. Then, the atmospheric pressure was increased to 8 kPa, and the reaction was further continued for 1 hour. The resulting reaction product was called as polyester A (PES-A).

For polyester A thus obtained, the coefficient of static friction was measured in the following manner.

Using polyester A obtained, the coefficient of static friction was measured based on ASTM-D1894-72 in an atmosphere of 25° C. As a result of the measurement, the coefficient of static friction determined was 0.34.

Further, for polyester A obtained, the softening point was measured. The softening point was measured with a descent type flow tester (manufactured by Shimadzu Corp.) in the following manner.

A load of 20 kg/cm$^2$ was applied to a 1-cm$^3$ sample with a plunger, while heating the sample at a rate of temperature rise of 6° C./minute, and the sample was extruded through a nozzle having a diameter of 1 mm and a length of 1 mm, thereby drawing a curve indicating the relationship between the descent amount of the plunger of the flow tester (flow value) and the temperature. When the height of this S curve was taken as h, the temperature corresponding to h/2 was taken as the softening point. As a result of the measurement, the softening point determined was 122° C.

Further, for polyester A obtained, it was attempted to measure the endothermic peak of the melting point with a differential scanning calorimetric analyzer (DSC210, manufactured by Seiko Instruments Inc.). The endothermic peak of the melting point was measured by elevating the temperature of a sample of polyester A to 300° C. at a rate of temperature rise of 10° C./minute, further lowering it to 20° C. at a rate of temperature decrease of 10° C./minute, and then elevating it at a rate of temperature rise of 10° C./minute. As a result, a sharp peak that can be judged to be the endothermic peak of the melting point could not be confirmed. The measured value of the glass transition point Tg (° C.) of polyester A was 58° C.

(B1.2) Production of Polyester B

A hundred grams of propylene glycol as an alcohol component and 100 g of terephthalic acid as an acid component were prepared. These were reacted with each other in a flask equipped with a nitrogen-introducing pipe and a dewatering pipe at 200° C. for 6 hours. Then, the atmospheric pressure was increased to 8 kPa, and the reaction was further continued for 1 hour. The resulting reaction product was called as polyester B (PES-B).

For polyester B thus obtained, the coefficient of static friction and the softening point were each measured in the same manner as described above. The coefficient of static friction determined from a result of the measurement was 0.28, and the softening point was 82° C.

For polyester B obtained, the endothermic peak of the melting point was measured with a differential scanning calorimetric analyzer (DSC210, manufactured by Seiko Instruments Inc.). The endothermic peak of the melting point was measured by elevating the temperature of a sample of polyester B to 300° C. at a rate of temperature rise of 10° C./minute, further lowering it to 20° C. at a rate of temperature decrease of 10° C./minute, and then elevating it at a rate of temperature rise of 10° C./minute. The center value $T_{mp}$ of the endothermic peak of the melting point was 85° C., and the shoulder peak value $T_{ms}$ was 68° C.

(B1.3) Production of Polyester C

A hundred grams of propylene glycol as an alcohol component and 100 g of maleic acid as an acid component were prepared. These were reacted with each other in a flask equipped with a nitrogen-introducing pipe and a dewatering pipe at 200° C. for 6 hours. Then, the atmospheric pressure was increased to 8 kPa, and the reaction was further continued for 1 hour. The resulting reaction product was called as polyester C (PES-C).

For polyester C thus obtained, the coefficient of static friction and the softening point were each measured in the same manner as described above. The coefficient of static friction determined from a result of the measurement was 0.23, and the softening point was 69° C.

Further, for polyester C obtained, the endothermic peak of the melting point was measured with a differential scanning calorimetric analyzer (DSC210, manufactured by Seiko Instruments Inc.). The endothermic peak of the melting point was measured by elevating the temperature of a sample of polyester C to 300° C. at a rate of temperature rise of 10° C./minute, further lowering it to 20° C. at a rate of temperature decrease of 10° C./minute, and then elevating it at a rate of temperature rise of 10° C./minute. The center value $T_{mp}$ of the endothermic peak of the melting point was 72° C., and the shoulder peak value $T_{ms}$ was 63° C.

(B1.4) Production of Polyester D

A hundred grams of butylene glycol as an alcohol component and 100 g of terephthalic acid as an acid component were prepared. These were reacted with each other in a flask equipped with a nitrogen-introducing pipe and a dewatering pipe at 200° C. for 6 hours. Then, the atmospheric pressure was increased to 8 kPa, and the reaction was further continued for 1 hour. The resulting reaction product was called as polyester D (PES-D).

For polyester D thus obtained, the coefficient of static friction and the softening point were each measured in the same manner as described above. The coefficient of static friction determined from a result of the measurement was 0.32, and the softening point was 242° C.

Further, for polyester D obtained, the endothermic peak of the melting point was measured with a differential scanning calorimetric analyzer (DSC210, manufactured by Seiko Instruments Inc.). The endothermic peak of the melting point was measured by elevating the temperature of a sample of polyester C to 300° C. at a rate of temperature rise of 10° C./minute, further lowering it to 20° C. at a rate of temperature decrease of 10° C./minute, and then elevating it at a rate of temperature rise of 10° C./minute. The center value $T_{mp}$ of the endothermic peak of the melting point was 246° C., and the shoulder peak value $T_{ms}$ was 218° C.

The degrees of static friction and the softening points of polyester A, polyester B3, polyester C and polyester D are summarized in Table B1. In Table B1, polyester A, polyester B, polyester C and polyester D are indicated by PES-A, PES-B, PES-C and PES-D, respectively.

TABLE B1

| | Degree of Static Friction μ | Softening Point Ts (° C.) | $T_{mp}$-$T_{ms}$ (° C.) |
|---|---|---|---|
| EPS-A | 0.34 | 122 | — |
| EPS-B | 0.28 | 82 | 17 |
| EPS-C | 0.23 | 69 | 9 |
| EPS-D | 0.32 | 242 | 28 |

(B2) Production of Toners

Toners were produced as described below.

Example B1

First, 90 parts by weight of polyester A as a first polyester resin, 10 parts by weight of polyester B as a second polyester resin, 5 parts by weight of a copper phthalocyanine pigment as a coloring agent and 1 part by weight of a chromium salicylate complex as an antistatic agent were prepared.

These respective components were mixed by the use of a Henschel mixer to obtain a raw material for production of a toner.

Then, this raw material (mixture) was kneaded with a double-screw extruder as described in FIG. 1. The material temperature in kneading was 125° C.

The kneaded material extruded through an extrusion outlet of the kneader was cooled with a cooling device as shown in FIG. 1.

The kneaded material cooled as described above was crudely pulverized (average particle size: 1 to 2 mm), and subsequently finely pulverized. A hammer mill was used for the crude pulverization of the kneaded material, and a jet mill was used for the fine pulverization of the kneaded material.

The pulverized material thus obtained was classified with an airflow type size classifier. Then, 1.2 parts by weight of silica was mixed by the use of a Henschel mixer with 100 parts by weight of the powder obtained by the classification, to obtain a toner. The average particle size of the toner finally obtained was 8.0 μm.

Example B2

The pulverized material obtained in the same manner as in Example B1 was classified with an airflow type size classifier.

Then, thermal conglobation treatment was conducted on the powder obtained by the classification (the powder for production of a toner). The thermal conglobation treatment was conducted by the use of a thermal conglobation apparatus (Type SFS3, manufactured by Nippon Pneumatic Mfg. Co., Ltd.). The atmospheric temperature in the thermal conglobation treatment was 300° C. Then, 1.2 parts by weight of silica was mixed by the use of a Henschel mixer with 100 parts by weight of the powder on which the thermal conglobation treatment was conducted to obtain a toner. The average particle size of the toner finally obtained was 8.0 μm.

Example B3

A toner was produced in the same manner as in Example B1 with the exception that polyester C was used as the second polyester resin.

Example B4

The pulverized material obtained in the same manner as in Example B3 was classified with an airflow type size classifier.

Then, thermal conglobation treatment was conducted on the powder obtained by the classification (the powder for production of a toner). The thermal conglobation treatment was conducted by the use of a thermal conglobation apparatus (Type SFS3, manufactured by Nippon Pneumatic Mfg. Co., Ltd.). The atmospheric temperature in the thermal conglobation treatment was 300° C. Then, 1.2 parts by weight of silica was mixed by the use of a Henschel mixer with 100 parts by weight of the powder on which the thermal conglobation treatment was conducted to obtain a toner. The average particle size of the toner finally obtained was 8.0 μm.

Examples B5 to B8

Toners were produced in the same manner as in Example B4 with the exception that the compounding ratio of the respective components in the raw material was changed as shown in Table B2.

Example B9

A toner was produced in the same manner as in Example B4 with the exception that 2 parts by weight of carnauba wax (an ester-based wax) was added to the raw material used for production of the toner.

Example B10

A toner was produced in the same manner as in Example B4 with the exception that 80 parts by weight of polyester A, 10 parts by weight of polyester C, 10 parts by weight of a styrene-acrylic resin (S-LEC P, manufactured by Sekisui Chemical Co., Ltd.), 2 parts by weight of carnauba wax (an ester-based wax), 5 parts by weight of the copper phthalocyanine pigment and 1 part by weight of the chromium salicylate complex were used as the raw material for production of the toner.

Comparative Example B1

A toner was produced in the same manner as in Example B1 with the exception that 90 parts by weight of polyester A, 10 parts by weight of polyester D, 5 parts by weight of the copper phthalocyanine pigment and 1 part by weight of the chromium salicylate complex were used as the raw material for production of the toner.

Comparative Example B2

The pulverized material obtained in the same manner as in Comparative Example B1 was classified with an airflow type size classifier.

Then, thermal conglobation treatment was conducted on the powder obtained by the classification (the powder for production of a toner). The thermal conglobation treatment was conducted by the use of a thermal conglobation apparatus (Type SFS3, manufactured by Nippon Pneumatic Mfg. Co., Ltd.). The atmospheric temperature in the thermal conglobation treatment was 300° C. Then, 1.2 parts by weight of silica was mixed by the use of a Henschel mixer with 100 parts by weight of the powder on which the thermal conglobation treatment was conducted to obtain a toner. The average particle size of the toner finally obtained was 8.0 μm.

Comparative Example B3

A toner was produced in the same manner as in Example B1 with the exception that 100 parts by weight of polyester A, 5 parts by weight of the copper phthalocyanine pigment and 1 part by weight of the chromium salicylate complex were used as the raw material for production of the toner.

Comparative Example B4

The pulverized material obtained in the same manner as in Comparative Example B3 was classified with an airflow type size classifier.

Then, thermal conglobation treatment was conducted on the powder obtained by the classification (the powder for production of a toner). The thermal conglobation treatment was conducted by the use of a thermal conglobation apparatus (Type SFS3, manufactured by Nippon Pneumatic Mfg. Co., Ltd.). The atmospheric temperature in the thermal conglobation treatment was 300° C. Then, 1.2 parts by weight of silica was mixed by the use of a Henschel mixer with 100 parts by weight of the powder on which the thermal conglobation treatment was conducted to obtain a toner. The average particle size of the toner finally obtained was 8.0 μm.

Comparative Example B5

A toner was produced in the same manner as in Example B1 with the exception that 100 parts by weight of polyester C, 5 parts by weight of the copper phthalocyanine pigment and 1 part by weight of the chromium salicylate complex were used as the raw material for production of the toner.

Comparative Example B6

The pulverized material obtained in the same manner as in Comparative Example B5 was classified with an airflow type size classifier.

Then, thermal conglobation treatment was conducted on the powder obtained by the classification (the powder for production of a toner). The thermal conglobation treatment was conducted by the use of a thermal conglobation apparatus (Type SFS3, manufactured by Nippon Pneumatic Mfg. Co., Ltd.). The atmospheric temperature in the thermal conglobation treatment was 300° C. Then, 1.2 parts by weight of silica was mixed by the use of a Henschel mixer with 100 parts by weight of the powder on which the thermal conglobation treatment was conducted to obtain a toner. The average particle size of the toner finally obtained was 8.0 μm.

Comparative Example B7

A toner was produced in the same manner as in Example B1 with the exception that 100 parts by weight of polyester A, 15 parts by weight of carnauba wax (an ester-based wax), 5 parts by weight of the copper phthalocyanine pigment as the coloring agent and 1 part by weight of the chromium salicylate complex as the antistatic agent were used as the raw material for production of the toner.

Comparative Example B8

The pulverized material obtained in the same manner as in Comparative Example B7 was classified with an airflow type size classifier.

Then, thermal conglobation treatment was conducted on the powder obtained by the classification (the powder for production of a toner). The thermal conglobation treatment was conducted by the use of a thermal conglobation apparatus (Type SFS3, manufactured by Nippon Pneumatic Mfg. Co., Ltd.). The atmospheric temperature in the thermal conglobation treatment was 300° C. Then, 1.2 parts by weight of silica was mixed by the use of a Henschel mixer with 100 parts by weight of the powder on which the thermal conglobation treatment was conducted to obtain a toner. The average particle size of the toner finally obtained was 8.0 μm.

The raw materials used for production of the toners and toner conditions are summarized in Table B2. In Table B2, polyester A, polyester B, polyester C and polyester D are indicated by PES-A, PES-B, PES-C and PES-D, respectively, the styrene-acrylic resin is indicated by StAc, and the antistatic agent is indicated by CCA.

TABLE B2

| | Raw Material | | | | | Toner | | | | |
|---|---|---|---|---|---|---|---|---|---|---|
| | | Content (parts by weight) | | | | | | | | Average |
| | Type of | | | Coloring | | Thermal Conglobation | Type of | Content (wt %) | | Particle Size |
| | Resin | Resin | Wax | Agent | CCA | Treatment | Resin | Resin | Wax | (μm) |
| Ex. B1 | PES-A | 90 | — | 5 | 1 | Not | PES-A | 84.9 | — | 8.0 |
| | PES-B | 10 | | | | conducted | PES-B | 9.4 | | |
| Ex. B2 | PES-A | 90 | — | 5 | 1 | Conducted | PES-A | 84.9 | — | 8.1 |
| | PES-B | 10 | | | | | PES-B | 9.4 | | |
| Ex. B3 | PES-A | 90 | — | 5 | 1 | Not | PES-A | 84.9 | — | 8.1 |
| | PES-C | 10 | | | | conducted | PES-C | 9.4 | | |
| Ex. B4 | PES-A | 90 | — | 5 | 1 | Conducted | PES-A | 84.9 | — | 8.1 |
| | PES-C | 10 | | | | | PES-C | 9.4 | | |
| Ex. B5 | PES-A | 80 | — | 5 | 1 | Conducted | PES-A | 75.5 | — | 8.1 |
| | PES-C | 20 | | | | | PES-C | 18.9 | | |
| Ex. B6 | PES-A | 70 | — | 5 | 1 | Conducted | PES-A | 66.0 | — | 8.1 |
| | PES-C | 30 | | | | | PES-C | 28.3 | | |
| Ex. B7 | PES-A | 60 | — | 5 | 1 | Conducted | PES-A | 56.6 | — | 8.1 |
| | PES-C | 40 | | | | | PES-C | 37.7 | | |
| Ex. B8 | PES-A | 50 | — | 5 | 1 | Conducted | PES-A | 47.2 | — | 8.1 |
| | PES-C | 50 | | | | | PES-C | 47.2 | | |
| Ex. B9 | PES-A | 90 | 2 | 5 | 1 | Conducted | PES-A | 83.3 | — | 8.1 |
| | PES-C | 10 | | | | | PES-C | 9.3 | | |
| Ex. | PES-A | 80 | 2 | 5 | 1 | Conducted | PES-A | 74.1 | 1.9 | 8.1 |
| B10 | PES-C | 10 | | | | | PES-C | 9.3 | | |
| | StAc | 10 | | | | | StAc | 9.3 | | |
| Comp. | PES-A | 90 | — | 5 | 1 | Not | PES-A | 84.9 | — | 8.0 |
| Ex. B1 | PES-D | 10 | | | | conducted | PES-D | 9.4 | | |
| Comp. | PES-A | 90 | — | 5 | 1 | Conducted | PES-A | 84.9 | — | 8.1 |
| Ex. B2 | PES-D | 10 | | | | | PES-D | 9.4 | | |
| Comp. | PES-A | 100 | — | 5 | 1 | Not | PES-A | 94.3 | — | 8.0 |
| Ex. B3 | | | | | | conducted | | | | |
| Comp. | PES-A | 100 | — | 5 | 1 | Conducted | PES-A | 94.3 | — | 8.1 |
| Ex. B4 | | | | | | | | | | |
| Comp. | PES-C | 100 | — | 5 | 1 | Not | PES-C | 94.3 | — | 8.0 |
| Ex. B5 | | | | | | conducted | | | | |
| Comp. | PES-C | 100 | — | 5 | 1 | Conducted | PES-C | 94.3 | — | 8.1 |
| Ex. B6 | | | | | | | | | | |
| Comp. | PES-A | 100 | 15 | 5 | 1 | Not | PES-A | 82.6 | 12.4 | 8.0 |
| Ex. B7 | | | | | | conducted | | | | |
| Comp. | PES-A | 100 | 15 | 5 | 1 | Conducted | PES-A | 82.6 | 12.4 | 8.1 |
| Ex. B8 | | | | | | | | | | |

(B3) Evaluations

For each toner obtained as described above, evaluations of the average degree of circularity of the toner particles, the transfer efficiency, the fixing temperature region, the durability and the fogging were made.

(B3.1) Average Degree of Circularity

For the toners produced in Examples and Comparative Examples described above, the average degree of circularity R was measured. The degree of circularity was measured in an aqueous dispersion system with a flow type particle image analyzer (FPIA-2000, manufactured by SYSMEX Corporation). The degree of circularity R is represented by the following equation (I):

$$R=L_0/L_1 \quad \text{(I)}$$

wherein $L_1$ (μm) represents the circumferential length of a projected image of a toner particle to be measured, and $L_0$ (μm) represents the circumferential length of a complete circle having an area equivalent to that of the projected image of the toner particle to be measured.

(B3.2) Measurement of Transfer Efficiency

A cartridge of a color laser printer (LP-3000C, manufactured by Seiko Epson Corporation) was refilled with each of the toners produced in Examples and Comparative Examples described above, and a pattern for evaluation was printed on a color laser printer sheet (high quality plain paper, manufactured by Seiko Epson Corporation). The ratio of the toner weight on a photosensitive member just after the development process (before the transfer) to the toner weight on the photosensitive member after the transfer (after the printing) was determined as the transfer efficiency.

(B3.3) Fixing Temperature Region

A cartridge of a color laser printer (LP-3000C, manufactured by Seiko Epson Corporation) was refilled with each of the toners produced in Examples and Comparative Examples described above. The fixing temperature of a fixing roll of a fixing device was variously changed, and a pattern for evaluation was printed on color laser printer sheets (high quality plain paper, manufactured by Seiko Epson Corporation). The temperature width of a temperature region within which offset did not occur on the print patterns printed on the sheets was taken as the fixing temperature region.

(B3.4) Durability

A cartridge of a color laser printer (LP-3000C, manufactured by Seiko Epson Corporation) was refilled with each of the toners produced in Examples and Comparative Examples described above, and a pattern for evaluation was printed. After running on 5,000 sheets, images on the 4901st to 5000th sheets of printed matter were evaluated according to the following four-stage criteria:

Excellent: Streaks and distortions were not observed at all in the images.

Good: Streaks and distortions were scarcely observed in the images.

Fair: Streaks and distortions were somewhat observed in the images.

Poor: Streaks and distortions were obviously observed in the images.

(B3.5) Fogging

A cartridge of a color laser printer (LP-3000C, manufactured by Seiko Epson Corporation) was refilled with each of the toners produced in Examples and Comparative Examples described above, and a pattern for evaluation was printed. After running on 5,000 sheets, images on the 4901st to 5000th sheets of printed matter were evaluated according to the following four-stage criteria:

Excellent: Fogging was not observed at all in the images.

Good: Fogging was scarcely observed in the images.

Fair: Fogging was somewhat observed in the images.

Poor: Fogging was obviously observed in the images.

The results of these are summarized in Table B3.

TABLE B3

| | Average Degree of Circularity | Transfer Efficiency (%) | Fixing Temperature Region (° C.) | Durability | Fogging |
|---|---|---|---|---|---|
| Example B1 | 0.91 | 95.1 | 110-180 | Excellent | Excellent |
| Example B2 | 0.96 | 99.0 | 110-180 | Excellent | Excellent |
| Example B3 | 0.93 | 95.8 | 110-180 | Excellent | Excellent |
| Example B4 | 0.97 | 99.3 | 110-180 | Excellent | Excellent |
| Example B5 | 0.97 | 99.0 | 110-180 | Excellent | Excellent |
| Example B6 | 0.97 | 98.7 | 100-170 | Excellent | Excellent |
| Example B7 | 0.97 | 98.5 | 100-160 | Excellent | Excellent |
| Example B8 | 0.97 | 98.0 | 100-150 | Excellent | Excellent |
| Example B9 | 0.97 | 99.6 | 100-200 | Excellent | Excellent |
| Example B10 | 0.97 | 99.5 | 100-200 | Excellent | Excellent |
| Comparative Example B1 | 0.91 | 89.3 | 150-170 | Fair | Fair |
| Comparative Example B2 | 095 | 92.6 | 150-170 | Fair | Fair |
| Comparative Example B3 | 0 91 | 88.8 | 130-160 | Fair | Fair |
| Comparative Example B4 | 0.95 | 95.4 | 130-160 | Fair | Fair |
| Comparative Example B5 | 0.91 | 86.0 | 110-120 | Poor | Poor |
| Comparative Example B6 | 0.95 | 95.5 | 110-120 | Poor | Poor |
| Comparative Example B7 | 0.91 | 82.3 | 100-160 | Poor | Poor |
| Comparative Example B8 | 0.97 | 88.2 | 100-160 | Poor | Poor |

As apparent from Table B3, the toners of the invention were all excellent in the transfer efficiency and durability. Further, good fixing quality was obtained in the wide temperature region, and the occurrence of an adverse effect such as offset was effectively prevented. In particular, the toners on which the thermal conglobation treatment was conducted, or in which the second polyester resin content was within the preferred range provided extremely excellent results. Still further, it is revealed that addition of a small amount of wax results in the more excellent transfer efficiency.

Furthermore, in the printed matter of the invention, the occurrence of fogging and offset was not observed, and extremely clear print patterns were formed.

In addition, writing was conducted on printed areas of the printed matter of the invention with a ball pen and a highlight pen, As a result, no thin spots were developed, and clear writing can be easily conducted.

In contrast, the toners obtained in Comparative Examples were poor in the transfer efficiency. The toners of Comparative Examples B1, B3, B5 and B7 on which the thermal conglobation treatment was not conducted were particularly low in the transfer efficiency among others.

Further, the toner of Comparative Example B6 was relatively high in the transfer efficiency. However, the fixing temperature region was extremely narrow, and the durability was also very low.

Furthermore, in the toners of Comparative Examples B7 and B8, a large amount of wax oozed out to surfaces of the toner particles, and the transfer efficiency of the toner was extremely low.

In the printed matter obtained by printing by the use of the toners of Comparative Examples, fogging and offset remarkably occurred.

In addition, toners were prepared in the same manner as in Examples and Comparative Examples described above with the exception that Pigment Red 57:1, C.I. Pigment Yellow 93 and carbon black were used as the coloring agent in place of the copper phthalocyanine pigment, and evaluated in the same manner as describe above. As a result, results similar to those of Examples and Comparative Examples described above were obtained.

As described above, according to the invention, the toner excellent in the transfer efficiency and durability can be provided. Further, the clear printed matter decreased in fogging and offset can be provided.

Such advantages can be further improved by controlling the composition of the first polyester resin and the second polyester resin, and the compounding ratio thereof.

This application is based on Japanese Patent Application Nos. 2002-72973 and 2002-72974 both filed Mar. 15, 2002, the contents thereof being incorporated herein by reference.

While the invention has been described in detail and with reference to specific embodiments thereof, it will be apparent to one skilled in the art that various changes and modifications can be made therein without departing from the spirit and scope thereof.

What is claimed is:

1. A method for producing a toner comprising:

(a) a step of preparing a powder for production of the toner from a raw material containing a resin as a main component, a coloring agent, a crystalline polyester having higher crystallinity than the resin as an accessory component, and an ester-based wax having a softening point of 50 to 100° C. in an amount of 0.5% to 5% by weight, wherein said step of preparing a powder comprises:

(i) mixing the raw material;

(ii) kneading the raw material at a temperature of 100 to 200° C. using a twin-screw kneading extruder having a head, wherein the head comprises an internal space having a cross sectional area-decreasing section in which the cross sectional area gradually decreases toward an extrusion outlet;

(iii) cooling the kneaded product extruded from the head of the kneading extruder while shaping it into a tabular form having an approximately uniform thickness using a belt cooling device, which comprises two sets of rolls and two belts wherein each belt is put around a set of two rolls, and wherein the kneaded product is introduced between the two belts and cooled; and (iv) pulverizing the cooled kneaded product; and (b) a thermal conglobation step of conglobating the powder for production of the toner with heat, wherein (i) the thermal conglobation step is carried out at an atmospheric temperature of from 200 to 400° C., (ii) the content of the resin in the raw material is from 80 to 98% by weight, (iii) the crystalline polyester has a melting point of 50 to 120° C., and (iv) the content of the crystalline polyester in the raw material is from 2 to 15 parts by weight per 100 parts by weight of the resin, wherein the toner has average degree of circularity R, which is represented by the following equation (I):

$$R=L_0/L_1 \quad (I)$$

wherein $L_1$ (μm) represents the circumferential length of a projected image of a toner particle to be measured, and $L_0$ (μm) represents the circumferential length of a complete circle having an area equivalent to that of the projected image of the toner particle to be measured, of 0.92 to 0.978; and wherein the resin as a main component is a polyester having lower crystallinity than the crystalline polyester resin serving as the accessory component.

2. The method according to claim 1, wherein the crystalline polyester satisfies the relationship $T_{mp}-T_{ms}\leqq 30$(° C.), wherein when an endothermic peak of the melting point is measured by differential scanning calorimetric analysis, the center value of the peak is taken as $T_{mp}$(° C.) and the shoulder peak value as $T_{ms}$ (° C.).

3. The method according to claim 1, wherein the crystalline polyester has a heat of fusion of 1 mJ/mg or more, which is determined when an endothermic peak of the melting point is measured by differential scanning calorimetric analysis.

4. The method according to claim 1, wherein the crystalline polyester contains an aliphatic carboxylic acid as an acid component.

5. The method according to claim 1, wherein the crystalline polyester contains an aliphatic alcohol as an alcohol component.

6. The method according to claim 1, wherein the crystalline polyester is a linear polymer.

7. The method according to claim 1, wherein the toner has an average particle size of 2 to 20 μm.

8. A method for producing a toner comprising the steps of:

kneading a raw material containing a resin and a coloring agent at a temperature of 100 to 200° C. using a twin-screw kneading extruder having a head, wherein the head comprises an internal space having a cross sectional area-decreasing section in which the cross sectional area gradually decreases toward an extrusion outlet; cooling the kneaded product extruded from the head of the kneading extruder while shaping it into a tabular form having an approximately uniform thickness using a belt cooling device, which comprises two sets of rolls and two belts wherein each belt is put around a set of two rolls, and wherein the kneaded product is introduced between the two belts and cooled; and pulverizing the cooled kneaded product, wherein the resin comprises at least a first polyester resin and a second polyester resin different from the first polyester resin, and wherein when the coefficient of static friction of the first polyester resin is taken as $u_1$, the coefficient of static friction of the second polyester resin as $u_2$, the softening point of the first polyester resin as Ts1(° C.) and the softening point of the second polyester resin as Ts2(° C.), the relationship $u_1>u_2$ and the relationship Ts1>Ts2 are satisfied.

9. The method according to claim 8, which comprises a thermal conglobation step of conglobating a powder for production of the toner, which is obtained by pulverizing the kneaded material, with heat.

10. The method according to claim 9, wherein the atmospheric temperature in the thermal conglobation step is from 150° C. to 500° C.

11. The method according to claim 9, wherein the thermal conglobation step causes the toner to have an average degree of circularity R, which is represented by the following equation (I), of 0.92 or more:

$$R=L0/L1 \quad (I)$$

wherein L1 (μm) represents the circumferential length of a projected image of a toner particle to be measured, and L0 (μm) represents the circumferential length of a complete circle having an area equivalent to that of the projected image of the toner particle to be measured.

12. The method according to claim 8, wherein when the content of the first polyester resin is taken as C1 (% by weight) and the content of the second polyester resin as C2 (% by weight), the relationship C1>C2 is satisfied.

13. The method according to claim 8, wherein the content of the first polyester resin in the raw material is from 50% to 99% by weight.

14. The method according to claim 8, wherein the softening point of the first polyester resin is from 50° C. to 300° C.

15. The method according to claim 8, wherein the content of the second polyester resin in the raw material is from 1% to 50% by weight.

16. The method according to claim 8, wherein the softening point of the second polyester resin is from 40° C. to 200° C.

17. The method according to claim 8, wherein the second polyester resin contains an aliphatic carboxylic acid as an acid component.

18. The method according to claim 8, wherein the second polyester resin contains an aliphatic alcohol as an alcohol component.

19. The method according to claim 8, wherein the second polyester resin is a linear polymer.

20. The method according to claim 8, wherein the second polyester resin satisfies the relationship Tmp−Tms±30(° C.), wherein when an endothermic peak of the melting point is measured by differential scanning calorimetric analysis, the center value of the peak is taken as Tmp (° C.) and the shoulder peak value as Tms (° C.).

21. The method according to claim 8, wherein the content of the resin in the raw material is from 51% to 99% by weight.

22. The method according to claim 8, wherein the toner has an average particle size of 2 to 20 μm.

23. The method according to claim 8, wherein the raw material further comprises a wax and the content of the wax in the raw material is 20% by weight or less.

* * * * *